US009928950B2

(12) United States Patent
Lubinski et al.

(10) Patent No.: US 9,928,950 B2
(45) Date of Patent: Mar. 27, 2018

(54) POLARIZED MAGNETIC ACTUATORS FOR HAPTIC RESPONSE

(71) Applicant: Apple Inc., Cupertino, CA (US)

(72) Inventors: Nicholaus Ian Lubinski, San Francisco, CA (US); James E. Wright, Cupertino, CA (US); Jonah A. Harley, Los Gatos, CA (US); John M. Brock, Menlo Park, CA (US); Keith J. Hendren, San Francisco, CA (US); Storrs T. Hoen, Cupertino, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 15/025,254

(22) PCT Filed: Sep. 27, 2013

(86) PCT No.: PCT/US2013/062449
§ 371 (c)(1),
(2) Date: Mar. 25, 2016

(87) PCT Pub. No.: WO2015/047343
PCT Pub. Date: Apr. 2, 2015

(65) Prior Publication Data

US 2016/0233012 A1 Aug. 11, 2016

(51) Int. Cl.
*H01F 7/14* (2006.01)
*H01F 7/12* (2006.01)
(Continued)

(52) U.S. Cl.
CPC ..... *H01F 7/14* (2013.01); *H01F 7/12* (2013.01); *H01F 7/122* (2013.01); *H01F 7/16* (2013.01);
(Continued)

(58) Field of Classification Search
CPC ... H01F 7/12; H01F 7/122; H01F 7/14; H01F 41/02; H01F 7/16; H01F 7/1646; H01F 2007/1661
See application file for complete search history.

(56) References Cited

U.S. PATENT DOCUMENTS 3,001,049 A * 9/1961 Didier ..... H01H 51/12 335/124
3,390,287 A 6/1968 Sonderegger
(Continued)

FOREIGN PATENT DOCUMENTS

AU 2015100710 7/2015
CA 2355434 2/2002
(Continued)

OTHER PUBLICATIONS

International Search Report and Written Opinion dated May 21, 2014, PCT/US2013/062449, 12 pages.
(Continued)

*Primary Examiner* — Bernard Rojas
(74) *Attorney, Agent, or Firm* — Brownstein Hyatt Farber Schreck, LLP

(57) ABSTRACT

A polarized electromagnetic actuator includes a movable armature, a stator, and at least one coil wrapped around the stator. At least one permanent magnet is disposed over the stator. When a current is applied to the at least one coil, the at least one coil is configured to reduce a magnetic flux of at least one permanent magnet in one direction and increase a magnetic flux of at least one permanent magnet in another direction. The movable armature moves in the direction of the increased magnetic flux.

24 Claims, 14 Drawing Sheets

(51) Int. Cl.
*H01F 7/122* (2006.01)
*H01F 7/16* (2006.01)
*H01F 41/02* (2006.01)

(52) U.S. Cl.
CPC ..... *H01F 41/02* (2013.01); *H01F 7/1646* (2013.01); *H01F 2007/1661* (2013.01)

(56) References Cited

U.S. PATENT DOCUMENTS 3,419,739 A 12/1968 Clements
4,236,132 A 11/1980 Zissimopoulos
4,412,148 A 10/1983 Klicker et al.
4,414,984 A 11/1983 Zarudiansky
4,695,813 A 9/1987 Nobutoki et al.
4,975,616 A 12/1990 Park
5,010,772 A 4/1991 Bourland
5,245,734 A 9/1993 Issartel
5,283,408 A 2/1994 Chen
5,293,161 A 3/1994 MacDonald et al.
5,317,221 A 5/1994 Kubo et al.
5,365,140 A 11/1994 Ohya et al.
5,434,549 A 7/1995 Hirabayashi et al.
5,436,622 A 7/1995 Gutman et al.
5,510,584 A 4/1996 Norris
5,510,783 A 4/1996 Findlater et al.
5,513,100 A 4/1996 Parker et al.
5,587,875 A 12/1996 Sellers
5,590,020 A 12/1996 Sellers
5,602,715 A 2/1997 Lempicki et al.
5,619,005 A 4/1997 Shibukawa et al.
5,621,610 A 4/1997 Moore et al.
5,625,532 A 4/1997 Sellers
5,629,578 A 5/1997 Winzer et al.
5,635,928 A 6/1997 Takagi et al.
5,718,418 A 2/1998 Gugsch
5,739,759 A 4/1998 Nakazawa et al.
5,742,242 A 4/1998 Sellers
5,783,765 A 7/1998 Muramatsu
5,793,605 A 8/1998 Sellers
5,812,116 A 9/1998 Malhi
5,813,142 A 9/1998 Demon
5,818,149 A 10/1998 Safari et al.
5,896,076 A 4/1999 Van Namen
5,907,199 A 5/1999 Miller
5,951,908 A 9/1999 Cui et al.
5,959,613 A 9/1999 Rosenberg et al.
5,982,304 A 11/1999 Selker et al.
5,982,612 A 11/1999 Roylance
5,995,026 A 11/1999 Sellers
5,999,084 A 12/1999 Armstrong
6,078,308 A 6/2000 Rosenberg et al.
6,127,756 A 10/2000 Iwaki
6,135,886 A 10/2000 Armstrong
6,218,966 B1 4/2001 Goodwin
6,222,525 B1 4/2001 Armstrong
6,252,336 B1 6/2001 Hall
6,342,880 B2 1/2002 Rosenberg et al.
6,351,205 B1 2/2002 Armstrong
6,373,465 B2 4/2002 Jolly et al.
6,408,187 B1 6/2002 Merriam
6,411,276 B1 6/2002 Braun et al.
6,429,849 B1 8/2002 An
6,438,393 B1 8/2002 Surronen
6,444,928 B2 9/2002 Okamoto et al.
6,455,973 B1 9/2002 Ineson
6,465,921 B1 10/2002 Horng
6,552,404 B1 4/2003 Hynes
6,552,471 B1 4/2003 Chandran et al.
6,557,072 B2 4/2003 Osborn
6,642,857 B1 11/2003 Schediwy
6,693,626 B1 2/2004 Rosenberg
6,717,573 B1 4/2004 Shahoian et al.
6,809,462 B2 10/2004 Pelrine et al.
6,809,727 B2 10/2004 Piot et al.
6,864,877 B2 3/2005 Braun et al.
6,906,697 B2 6/2005 Rosenberg
6,906,700 B1 6/2005 Armstrong
6,906,703 B2 6/2005 Vablais et al.
6,952,203 B2 10/2005 Banerjee et al.
6,954,657 B2 10/2005 Bork et al.
6,963,762 B2 11/2005 Kaaresoja et al.
6,995,752 B2 2/2006 Lu
7,005,811 B2 2/2006 Wakuda et al.
7,016,707 B2 3/2006 Fujisawa et al.
7,022,927 B2 4/2006 Hsu
7,023,112 B2 4/2006 Miyamoto et al.
7,081,701 B2 7/2006 Yoon et al.
7,121,147 B2 10/2006 Okada
7,123,948 B2 10/2006 Nielsen
7,130,664 B1 10/2006 Williams
7,136,045 B2 11/2006 Rosenberg et al.
7,161,580 B2 1/2007 Bailey et al.
7,162,928 B2 1/2007 Shank et al.
7,170,498 B2 1/2007 Huang
7,176,906 B2 2/2007 Williams et al.
7,182,691 B1 2/2007 Schena
7,194,645 B2 3/2007 Bieswanger et al.
7,217,891 B2 5/2007 Fischer et al.
7,218,310 B2 5/2007 Tierling et al.
7,219,561 B2 5/2007 Okada
7,253,350 B2 8/2007 Noro et al.
7,333,604 B2 2/2008 Zernovizky et al.
7,334,350 B2 2/2008 Ellis
7,348,968 B2 3/2008 Dawson
7,388,741 B2 6/2008 Konuma et al.
7,392,066 B2 6/2008 Hapamas
7,423,631 B2 9/2008 Shahoian et al.
7,446,752 B2 11/2008 Goldenberg et al.
7,469,595 B2 12/2008 Kessler et al.
7,495,358 B2 2/2009 Kobayashi et al.
7,508,382 B2 3/2009 Denoue et al.
7,561,142 B2 7/2009 Shahoian et al.
7,562,468 B2 7/2009 Ellis
7,569,086 B2 8/2009 Chandran
7,586,220 B2 9/2009 Roberts
7,619,498 B2 11/2009 Miura
7,639,232 B2 12/2009 Grant et al.
7,641,618 B2 1/2010 Noda et al.
7,675,253 B2 3/2010 Dorel
7,675,414 B2 3/2010 Ray
7,679,611 B2 3/2010 Schena
7,707,742 B2 5/2010 Ellis
7,710,399 B2 5/2010 Bruneau et al.
7,732,951 B2 6/2010 Mukaide
7,742,036 B2 6/2010 Grant et al.
7,788,032 B2 8/2010 Moloney
7,793,429 B2 9/2010 Ellis
7,793,430 B2 9/2010 Ellis
7,798,982 B2 9/2010 Zets et al.
7,868,489 B2 1/2011 Amemiya et al.
7,886,621 B2 2/2011 Smith et al.
7,888,892 B2 2/2011 McReynolds et al.
7,893,922 B2 2/2011 Klinghult et al.
7,919,945 B2 4/2011 Houston et al.
7,929,382 B2 4/2011 Yamazaki
7,946,483 B2 5/2011 Miller et al.
7,952,261 B2 5/2011 Lipton et al.
7,952,566 B2 5/2011 Poupyrev et al.
7,956,770 B2 6/2011 Klinghult et al.
7,961,909 B2 6/2011 Mandella et al.
8,031,172 B2 10/2011 Kruse et al.
8,044,940 B2 10/2011 Narusawa
8,069,881 B1 12/2011 Cunha
8,077,145 B2 12/2011 Rosenberg et al.
8,081,156 B2 12/2011 Ruettiger
8,082,640 B2 12/2011 Takeda
8,098,234 B2 1/2012 Lacroix et al.
8,123,660 B2 2/2012 Kruse et al.
8,125,453 B2 2/2012 Shahoian et al.
8,141,276 B2 3/2012 Ellis
8,156,809 B2 4/2012 Tierling et al.
8,174,372 B2 5/2012 da Costa
8,179,202 B2 5/2012 Cruz-Hernandez et al.
8,188,623 B2 5/2012 Park

(56) References Cited

U.S. PATENT DOCUMENTS

| | | | |
|---|---|---|---|
| 8,205,356 | B2 | 6/2012 | Ellis |
| 8,210,942 | B2 | 7/2012 | Shimabukuro et al. |
| 8,232,494 | B2 | 7/2012 | Purcocks |
| 8,248,277 | B2 | 8/2012 | Peterson et al. |
| 8,248,278 | B2 | 8/2012 | Schlosser et al. |
| 8,253,686 | B2 | 8/2012 | Kyung et al. |
| 8,255,004 | B2 | 8/2012 | Huang et al. |
| 8,261,468 | B2 | 9/2012 | Ellis |
| 8,264,465 | B2 | 9/2012 | Grant et al. |
| 8,270,114 | B2 | 9/2012 | Argumedo et al. |
| 8,288,899 | B2 | 10/2012 | Park et al. |
| 8,291,614 | B2 | 10/2012 | Ellis |
| 8,294,600 | B2 | 10/2012 | Peterson et al. |
| 8,315,746 | B2 | 11/2012 | Cox et al. |
| 8,344,834 | B2 | 1/2013 | Niiyama |
| 8,378,797 | B2 | 2/2013 | Pance et al. |
| 8,378,798 | B2 | 2/2013 | Bells et al. |
| 8,378,965 | B2 | 2/2013 | Gregorio et al. |
| 8,384,679 | B2 | 2/2013 | Paleczny et al. |
| 8,390,594 | B2 | 3/2013 | Modarres et al. |
| 8,395,587 | B2 | 3/2013 | Cauwels et al. |
| 8,398,570 | B2 | 3/2013 | Mortimer et al. |
| 8,411,058 | B2 | 4/2013 | Wong et al. |
| 8,446,264 | B2 | 5/2013 | Tanase |
| 8,451,255 | B2 | 5/2013 | Weber et al. |
| 8,466,889 | B2 | 6/2013 | Tong et al. |
| 8,471,690 | B2 | 6/2013 | Hennig et al. |
| 8,487,759 | B2 | 7/2013 | Hill |
| 8,515,398 | B2 | 8/2013 | Song et al. |
| 8,542,134 | B2 | 9/2013 | Peterson et al. |
| 8,545,322 | B2 | 10/2013 | George et al. |
| 8,547,341 | B2 | 10/2013 | Takashima et al. |
| 8,552,859 | B2 | 10/2013 | Pakula et al. |
| 8,570,291 | B2 | 10/2013 | Motomura |
| 8,575,794 | B2 | 11/2013 | Lee et al. |
| 8,587,955 | B2 | 11/2013 | DiFonzo et al. |
| 8,598,893 | B2 | 12/2013 | Camus |
| 8,599,047 | B2 | 12/2013 | Schlosser et al. |
| 8,599,152 | B1 | 12/2013 | Wurtenberger et al. |
| 8,600,354 | B2 | 12/2013 | Esaki |
| 8,614,431 | B2 | 12/2013 | Huppi et al. |
| 8,621,348 | B2 | 12/2013 | Ramsay et al. |
| 8,633,916 | B2 | 1/2014 | Bernstein et al. |
| 8,674,941 | B2 | 3/2014 | Casparian et al. |
| 8,680,723 | B2 | 3/2014 | Subramanian |
| 8,681,092 | B2 | 3/2014 | Harada et al. |
| 8,682,396 | B2 | 3/2014 | Yang et al. |
| 8,686,952 | B2 | 4/2014 | Pope et al. |
| 8,710,966 | B2 | 4/2014 | Hill |
| 8,723,813 | B2 | 5/2014 | Park et al. |
| 8,735,755 | B2 | 5/2014 | Peterson et al. |
| 8,760,273 | B2 | 6/2014 | Casparian et al. |
| 8,787,006 | B2 | 7/2014 | Golko et al. |
| 8,797,152 | B2 | 8/2014 | Henderson et al. |
| 8,798,534 | B2 | 8/2014 | Rodriguez et al. |
| 8,836,502 | B2 | 9/2014 | Culbert et al. |
| 8,857,248 | B2 | 10/2014 | Shih et al. |
| 8,860,562 | B2 | 10/2014 | Hill |
| 8,861,776 | B2 | 10/2014 | Lastrucci |
| 8,866,600 | B2 | 10/2014 | Yang et al. |
| 8,890,668 | B2 | 11/2014 | Pance et al. |
| 8,928,621 | B2 | 1/2015 | Ciesla et al. |
| 8,948,821 | B2 | 2/2015 | Newham et al. |
| 8,970,534 | B2 | 3/2015 | Adachi et al. |
| 8,976,141 | B2 | 3/2015 | Myers et al. |
| 9,008,730 | B2 | 4/2015 | Kim et al. |
| 9,012,795 | B2 | 4/2015 | Niu |
| 9,013,426 | B2 | 4/2015 | Cole et al. |
| 9,019,088 | B2 | 4/2015 | Zawacki et al. |
| 9,072,576 | B2 | 7/2015 | Nishiura |
| 9,083,821 | B2 | 7/2015 | Hughes |
| 9,092,129 | B2 | 7/2015 | Abdo et al. |
| 9,098,991 | B2 | 8/2015 | Park et al. |
| 9,122,325 | B2 | 9/2015 | Peshkin et al. |
| 9,131,039 | B2 | 9/2015 | Behles |
| 9,134,834 | B2 | 9/2015 | Reshef |
| 9,158,379 | B2 | 10/2015 | Cruz-Hernandez et al. |
| 9,178,509 | B2 | 11/2015 | Bernstein |
| 9,189,932 | B2 | 11/2015 | Kerdemelidis et al. |
| 9,201,458 | B2 | 12/2015 | Hunt et al. |
| 9,202,355 | B2 | 12/2015 | Hill |
| 9,235,267 | B2 | 1/2016 | Pope et al. |
| 9,274,601 | B2 | 3/2016 | Faubert et al. |
| 9,274,602 | B2 | 3/2016 | Garg et al. |
| 9,274,603 | B2 | 3/2016 | Modarres et al. |
| 9,275,815 | B2 * | 3/2016 | Hoffmann ..... H01H 50/541 |
| 9,293,054 | B2 | 3/2016 | Bruni et al. |
| 9,300,181 | B2 | 3/2016 | Maeda et al. |
| 9,310,906 | B2 | 4/2016 | Yumiki et al. |
| 9,317,116 | B2 | 4/2016 | Ullrich et al. |
| 9,317,118 | B2 | 4/2016 | Puskarich |
| 9,318,942 | B2 | 4/2016 | Sugita et al. |
| 9,325,230 | B2 | 4/2016 | Yamada et al. |
| 9,357,052 | B2 | 5/2016 | Ullrich |
| 9,360,944 | B2 | 6/2016 | Pinault |
| 9,390,599 | B2 | 7/2016 | Weinberg |
| 9,396,434 | B2 | 7/2016 | Rothkopf |
| 9,405,369 | B2 | 8/2016 | Modarres et al. |
| 9,449,476 | B2 | 9/2016 | Lynn |
| 9,477,342 | B2 | 10/2016 | Daverman et al. |
| 9,501,912 | B1 | 11/2016 | Hayskjold et al. |
| 9,594,450 | B2 | 7/2017 | Lynn et al. |
| 9,779,592 | B1 | 10/2017 | Hoen |
| 2003/0210259 | A1 | 11/2003 | Liu |
| 2004/0021663 | A1 | 2/2004 | Suzuki et al. |
| 2004/0127198 | A1 | 7/2004 | Roskind et al. |
| 2005/0057528 | A1 | 3/2005 | Kleen |
| 2005/0107129 | A1 | 5/2005 | Kaewell et al. |
| 2005/0110778 | A1 | 5/2005 | Ben Ayed |
| 2005/0118922 | A1 | 6/2005 | Endo |
| 2005/0217142 | A1 | 10/2005 | Ellis |
| 2005/0237306 | A1 | 10/2005 | Klein et al. |
| 2005/0248549 | A1 | 11/2005 | Dietz et al. |
| 2005/0258715 | A1 | 11/2005 | Schlabach |
| 2006/0014569 | A1 | 1/2006 | DelGiorno |
| 2006/0154674 | A1 | 7/2006 | Landschaft et al. |
| 2006/0209037 | A1 | 9/2006 | Wang et al. |
| 2006/0239746 | A1 | 10/2006 | Grant |
| 2006/0252463 | A1 | 11/2006 | Liao |
| 2007/0099574 | A1 | 5/2007 | Wang |
| 2007/0152974 | A1 | 7/2007 | Kim et al. |
| 2007/0178942 | A1 | 8/2007 | Sadler et al. |
| 2007/0188450 | A1 | 8/2007 | Hernandez et al. |
| 2008/0084384 | A1 | 4/2008 | Gregorio et al. |
| 2008/0158149 | A1 | 7/2008 | Levin |
| 2008/0165148 | A1 | 7/2008 | Williamson |
| 2008/0181501 | A1 | 7/2008 | Faraboschi |
| 2008/0181706 | A1 | 7/2008 | Jackson |
| 2008/0192014 | A1 | 8/2008 | Kent et al. |
| 2008/0204428 | A1 | 8/2008 | Pierce et al. |
| 2008/0255794 | A1 | 10/2008 | Levine |
| 2009/0002328 | A1 | 1/2009 | Ullrich et al. |
| 2009/0115734 | A1 | 5/2009 | Fredriksson et al. |
| 2009/0120105 | A1 | 5/2009 | Ramsay et al. |
| 2009/0128503 | A1 | 5/2009 | Grant et al. |
| 2009/0135142 | A1 | 5/2009 | Fu et al. |
| 2009/0167702 | A1 | 7/2009 | Nurmi |
| 2009/0167704 | A1 | 7/2009 | Terlizzi et al. |
| 2009/0218148 | A1 | 9/2009 | Hugeback et al. |
| 2009/0225046 | A1 | 9/2009 | Kim et al. |
| 2009/0236210 | A1 | 9/2009 | Clark et al. |
| 2009/0267892 | A1 | 10/2009 | Faubert |
| 2009/0313542 | A1 | 12/2009 | Cruz-Hernandez |
| 2010/0020036 | A1 | 1/2010 | Hui et al. |
| 2010/0053087 | A1 | 3/2010 | Dai et al. |
| 2010/0079264 | A1 | 4/2010 | Hoellwarth |
| 2010/0089735 | A1 | 4/2010 | Takeda et al. |
| 2010/0141606 | A1 | 6/2010 | Bae et al. |
| 2010/0152620 | A1 | 6/2010 | Ramsay et al. |
| 2010/0164894 | A1 | 7/2010 | Kim et al. |
| 2010/0188422 | A1 | 7/2010 | Shingai et al. |
| 2010/0194547 | A1 | 8/2010 | Terrell et al. |
| 2010/0231508 | A1 | 9/2010 | Cruz-Hernandez et al. |
| 2010/0231550 | A1 | 9/2010 | Cruz-Hernandez et al. |

(56) References Cited

U.S. PATENT DOCUMENTS

| | | | |
|---|---|---|---|
| 2010/0265197 | A1 | 10/2010 | Purdy |
| 2010/0309141 | A1 | 12/2010 | Cruz-Hernandez et al. |
| 2010/0328229 | A1 | 12/2010 | Weber et al. |
| 2011/0053577 | A1 | 3/2011 | Lee et al. |
| 2011/0107958 | A1 | 5/2011 | Pance et al. |
| 2011/0121765 | A1 | 5/2011 | Anderson et al. |
| 2011/0128239 | A1 | 6/2011 | Polyakov et al. |
| 2011/0148608 | A1 | 6/2011 | Grant et al. |
| 2011/0163985 | A1 | 7/2011 | Bae et al. |
| 2011/0193824 | A1 | 8/2011 | Modarres et al. |
| 2011/0248948 | A1 | 10/2011 | Griffin et al. |
| 2011/0260988 | A1 | 10/2011 | Colgate et al. |
| 2011/0263200 | A1 | 10/2011 | Thornton et al. |
| 2011/0291950 | A1 | 12/2011 | Tong |
| 2011/0304559 | A1 | 12/2011 | Pasquero |
| 2012/0068957 | A1 | 3/2012 | Puskarich et al. |
| 2012/0075198 | A1 | 3/2012 | Sulem et al. |
| 2012/0092263 | A1 | 4/2012 | Peterson et al. |
| 2012/0126959 | A1 | 5/2012 | Zarrabi et al. |
| 2012/0127088 | A1 | 5/2012 | Pance et al. |
| 2012/0133494 | A1 | 5/2012 | Cruz-Hernandez et al. |
| 2012/0139844 | A1 | 6/2012 | Ramstein et al. |
| 2012/0256848 | A1 | 10/2012 | Madabusi Srinivasan |
| 2012/0268412 | A1 | 10/2012 | Cruz-Hernandez et al. |
| 2012/0274578 | A1 | 11/2012 | Snow et al. |
| 2012/0280927 | A1 | 11/2012 | Ludwig |
| 2012/0327006 | A1 | 12/2012 | Israr et al. |
| 2013/0027345 | A1 | 1/2013 | Binzel |
| 2013/0063285 | A1 | 3/2013 | Elias |
| 2013/0063356 | A1 | 3/2013 | Martisauskas |
| 2013/0076462 | A1 | 3/2013 | Gassmann et al. |
| 2013/0106699 | A1 | 5/2013 | Babatunde |
| 2013/0191741 | A1 | 7/2013 | Dickinson et al. |
| 2013/0200732 | A1 | 8/2013 | Jun et al. |
| 2013/0207793 | A1 | 8/2013 | Weaber et al. |
| 2013/0217491 | A1 | 8/2013 | Hilbert et al. |
| 2013/0222280 | A1 | 8/2013 | Sheynblat et al. |
| 2013/0228023 | A1 | 9/2013 | Drasnin et al. |
| 2013/0257776 | A1 | 10/2013 | Tissot |
| 2013/0261811 | A1 | 10/2013 | Yagi et al. |
| 2013/0300590 | A1 | 11/2013 | Dietz et al. |
| 2014/0035397 | A1 | 2/2014 | Endo et al. |
| 2014/0082490 | A1 | 3/2014 | Jung et al. |
| 2014/0197936 | A1 | 7/2014 | Biggs et al. |
| 2014/0232534 | A1 | 8/2014 | Birnbaum et al. |
| 2014/0247227 | A1 | 9/2014 | Jiang et al. |
| 2014/0267076 | A1 | 9/2014 | Birnbaum et al. |
| 2014/0267952 | A1 | 9/2014 | Sirois |
| 2015/0005039 | A1 | 1/2015 | Liu et al. |
| 2015/0090572 | A1 | 4/2015 | Lee et al. |
| 2015/0169059 | A1 | 6/2015 | Behles et al. |
| 2015/0192414 | A1 | 7/2015 | Das et al. |
| 2015/0194165 | A1 | 7/2015 | Faaborg et al. |
| 2015/0220199 | A1 | 8/2015 | Wang et al. |
| 2015/0227204 | A1 | 8/2015 | Gipson et al. |
| 2015/0296480 | A1 | 10/2015 | Kinsey et al. |
| 2015/0324049 | A1 | 11/2015 | Kies et al. |
| 2015/0349619 | A1 | 12/2015 | Degner et al. |
| 2016/0049265 | A1 | 2/2016 | Bernstein |
| 2016/0063826 | A1 | 3/2016 | Morrell et al. |
| 2016/0071384 | A1 | 3/2016 | Hill |
| 2016/0162025 | A1 | 6/2016 | Shah |
| 2016/0163165 | A1 | 6/2016 | Morrell et al. |
| 2016/0172953 | A1 | 6/2016 | Hamel et al. |
| 2016/0195929 | A1 | 7/2016 | Martinez et al. |
| 2016/0196935 | A1 | 7/2016 | Bernstein |
| 2016/0206921 | A1 | 7/2016 | Szabados et al. |
| 2016/0211736 | A1 | 7/2016 | Moussette et al. |
| 2016/0216764 | A1 | 7/2016 | Morrell et al. |
| 2016/0216766 | A1 | 7/2016 | Puskarich |
| 2016/0231815 | A1 | 8/2016 | Moussette et al. |
| 2016/0241119 | A1 | 8/2016 | Keeler |
| 2016/0259480 | A1 | 9/2016 | Augenbergs et al. |
| 2016/0306423 | A1 | 10/2016 | Uttermann et al. |
| 2016/0371942 | A1 | 12/2016 | Smith, IV et al. |
| 2017/0038905 | A1 | 2/2017 | Bijamov et al. |
| 2017/0257844 | A1 | 9/2017 | Miller et al. |
| 2017/0285747 | A1 | 10/2017 | Chen |
| 2017/0311282 | A1 | 10/2017 | Miller et al. |
| 2017/0357325 | A1 | 12/2017 | Yang et al. |
| 2017/0364158 | A1 | 12/2017 | Wen et al. |

FOREIGN PATENT DOCUMENTS

| | | | |
|---|---|---|---|
| CN | 101409164 | | 4/2009 |
| CN | 201829004 | | 5/2011 |
| CN | 102591512 | | 7/2012 |
| CN | 102713805 | | 10/2012 |
| CN | 102844972 | | 12/2012 |
| CN | 102915111 | | 2/2013 |
| CN | 103181090 | | 6/2013 |
| CN | 103218104 | | 7/2013 |
| CN | 103416043 | | 11/2013 |
| CN | 104220963 | | 12/2014 |
| DE | 19517630 | | 11/1996 |
| DE | 10330024 | | 1/2005 |
| DE | 102009038103 | | 2/2011 |
| DE | 102011115762 | | 4/2013 |
| EP | 0483955 | | 5/1992 |
| EP | 1047258 | | 10/2000 |
| EP | 1686776 | | 8/2006 |
| EP | 2060967 | | 5/2009 |
| EP | 2073099 | | 6/2009 |
| EP | 2194444 | | 6/2010 |
| EP | 2264562 | A2 | 12/2010 |
| EP | 2315186 | | 4/2011 |
| EP | 2374430 | | 10/2011 |
| EP | 2395414 | | 12/2011 |
| EP | 2461228 | | 6/2012 |
| EP | 2631746 | | 8/2013 |
| EP | 2434555 | | 10/2013 |
| JP | H05301342 | A2 | 11/1993 |
| JP | 2002199689 | | 7/2002 |
| JP | 2002102799 | | 9/2002 |
| JP | 200362525 | | 3/2003 |
| JP | 2004236202 | | 8/2004 |
| KR | 20050033909 | | 4/2005 |
| KR | 1020100046602 | | 5/2010 |
| KR | 1020110101516 | | 9/2011 |
| KR | 20130024420 | | 3/2013 |
| TW | 200518000 | | 11/2007 |
| TW | 200951944 | | 12/2009 |
| TW | 201218039 | | 5/2012 |
| WO | WO 97/16932 | | 5/1997 |
| WO | WO 01/059588 | | 8/2001 |
| WO | WO 02/073587 | | 9/2002 |
| WO | WO 03/038800 | | 5/2003 |
| WO | WO 06/057770 | | 6/2006 |
| WO | WO 07/114631 | | 10/2007 |
| WO | WO 08/075082 | | 6/2008 |
| WO | WO 09/038862 | | 3/2009 |
| WO | WO 09/068986 | | 6/2009 |
| WO | WO 09/097866 | | 8/2009 |
| WO | WO 09/122331 | | 10/2009 |
| WO | WO 09/150287 | | 12/2009 |
| WO | WO 10/085575 | | 7/2010 |
| WO | WO 10/087925 | | 8/2010 |
| WO | WO 11/007263 | | 1/2011 |
| WO | WO 12/052635 | | 4/2012 |
| WO | WO 12/129247 | | 9/2012 |
| WO | WO 13/069148 | | 5/2013 |
| WO | WO 13/169299 | | 11/2013 |
| WO | WO 13/169302 | | 11/2013 |
| WO | WO 14/018086 | | 1/2014 |
| WO | WO 15/023670 | | 2/2015 |

OTHER PUBLICATIONS

Astronomer's Toolbox, "The Electromagnetic Spectrum," http://imagine.gsfc.nasa.gov/science/toolbox/emspectrum1.html, updated Mar. 2013, 4 pages.

(56) References Cited

OTHER PUBLICATIONS

Hasser et al., "Preliminary Evaluation of a Shape-Memory Alloy Tactile Feedback Display," Advances in Robotics, Mechantronics, and Haptic Interfaces, ASME, DSC-vol. 49, pp. 73-80, 1993.
Hill et al., "Real-time Estimation of Human Impedance for Haptic Interfaces," Stanford Telerobotics Laboratory, Department of Mechanical Engineering, Stanford University, Third Joint Eurohaptics Conference and Symposium on Haptic Interfaces for Virtual Environment and Teleoperator Systems, Salt Lake City, Utah, Mar. 18-20, 2009, pp. 440-445.
Kim et al., "Tactile Rendering of 3D Features on Touch Surfaces," UIST '13, Oct. 8-11, 2013, St. Andrews, United Kingdom, 8 pages.
Lee et al, "Haptic Pen: Tactile Feedback Stylus for Touch Screens," Mitsubishi Electric Research Laboratories, http://wwwlmerl.com, 6 pages, Oct. 2004.
U.S. Appl. No. 12/750,054, filed Mar. 30, 2010, Hill.
U.S. Appl. No. 12/887,455, filed Sep. 21, 2010, Puskarich et al.
U.S. Appl. No. 12/950,940, filed Nov. 19, 2010, Pance et al.
U.S. Appl. No. 13/630,867, filed Sep. 28, 2012, Bernstein.
U.S. Appl. No. 13/943,639, filed Jul. 16, 2013, Hill.
U.S. Appl. No. 14/059,693, filed Oct. 22, 2013, Puskarich.
U.S. Appl. No. 14/165,475, filed Jan. 27, 2014, Hayskjold et al.
U.S. Appl. No. 14/493,190, filed Sep. 22, 2014, Hoen.
U.S. Appl. No. 14/512,927, filed Oct. 13, 2014, Hill.
U.S. Appl. No. 14/728,505, filed Jun. 2, 2015, Degner et al.
U.S. Appl. No. 14/841,582, filed Aug. 31, 2015, Morrell et al.
U.S. Appl. No. 14/928,465, filed Oct. 30, 2015, Bernstein.
U.S. Appl. No. 14/942,521, filed Nov. 16, 2015, Hill.
U.S. Appl. No. 14/910,108, filed Feb. 4, 2016, Martinez et al.
U.S. Appl. No. 15/045,761, filed Feb. 17, 2016, Morrell et al.
U.S. Appl. No. 15/046,194, filed Feb. 17, 2016, Degner et al.
U.S. Appl. No. 15/047,447, filed Feb. 18, 2016, Augenbergs et al.
U.S. Appl. No. 15/068,038, filed Mar. 11, 2016, Bernstein.
U.S. Appl. No. 15/025,243, filed Mar. 25, 2016, Keeler.
U.S. Appl. No. 15/025,425, filed Mar. 28, 2016, Moussette et al.
U.S. Appl. No. 15/025,277, filed Mar. 27, 2016, Morrell et al.
U.S. Appl. No. 15/025,250, filed Mar. 25, 2016, Moussette et al.
U.S. Appl. No. 15/091,501, filed Apr. 5, 2016, Puskarich.
U.S. Appl. No. 15/098,669, filed Apr. 14, 2016, Uttermann et al.
U.S. Appl. No. 15/102,826, filed Jun. 8, 2016, Smith et al.
U.S. Appl. No. 15/621,966, filed Jun. 13, 2017, Pedder et al.
U.S. Appl. No. 15/621,930, filed Jun. 13, 2017, Wen et al.
U.S. Appl. No. 15/622,017, filed Jun. 13, 2017, Yang et al.
U.S. Appl. No. 15/641,192, filed Jul. 3, 2017, Miller et al.

* cited by examiner

POLARIZED MAGNETIC ACTUATORS FOR HAPTIC RESPONSE

CROSS REFERENCE TO RELATED APPLICATION

This application is a 35 U.S.C. § 371 application of PCT/US2013/062449, filed on Sep. 27, 2013, and entitled "Polarized Magnetic Actuators for Haptic Response," which is incorporated by reference as if fully disclosed herein.

TECHNICAL FIELD

The present invention relates to actuators, and more particularly to electromagnetic actuators that include one or more permanent magnets.

BACKGROUND

An actuator is a device that converts one form of energy into some type of motion. There are several different types of actuators, including pneumatic, hydraulic, electrical, mechanical, and electromagnetic. An electromagnetic actuator provides mechanical motion in response to an electrical stimulus. The electromagnetic actuator typically includes a coil and a movable armature made of a ferromagnetic material. A magnetic field is produced around the coil when current flows through the coil. The magnetic field applies a force to the armature to move the armature in the direction of the magnetic field.

Some electromagnetic actuators are limited in the type of force that can be applied to an armature. For example, an armature can be pushed but not pulled. Additionally, some electromagnetic actuators may produce a negligible amount of force when a small amount of current is applied to the coil. And in some devices or components, such as in portable electronic devices or components used in portable electronic devices, it can be challenging to construct an electromagnetic actuator that has both a reduced size and an ability to generate a desired amount of force.

SUMMARY

In one aspect, a polarized electromagnetic actuator can include a movable armature and a stator, a first coil and a second coil wrapped around the stator, and a permanent magnet disposed over the stator. The moveable armature is spaced apart from the stator. The first and second coils produce a first magnetic flux in a first direction when a current is applied to the first and second coils. The first magnetic flux reduces a second magnetic flux of the permanent magnet in a first direction and increases the second magnetic flux in a second direction to produce motion in the movable armature in the second direction. The amount of force applied to the movable armature can be controlled by controlling the amount of current flowing through the first and second coils. Additionally, the direction of the force applied to the movable armature is dependent upon the direction of the current passing through the first and second coils.

In another aspect, a polarized electromagnetic actuator can include a movable armature and a stator having two tines extending out from the stator. The movable armature is spaced apart from the two tines of the stator. A first coil is wrapped around one tine and a second coil is wrapped around the other tine. At least one permanent magnet is disposed over the stator between the two tines. The first and second coils produce a first magnetic flux in a first direction when a current is applied to the first and second coils. The first magnetic flux reduces a second magnetic flux of the permanent magnet in a first direction and increases the second magnetic flux in a second direction to produce motion in the movable armature in the second direction. The amount of force applied to the movable armature can be controlled by controlling the amount of current flowing through the first and second coils. Additionally, the direction of the force applied to the movable armature is dependent upon the direction of the current passing through the first and second coils.

In yet another aspect, a polarized electromagnetic actuator can include a stator including two tines extending out from the stator and a coil wrapped around the stator between the two tines. A movable armature can include a first arm disposed over one tine of the stator, a second arm disposed over the other tine of the stator, and a body disposed between the two tines. A first permanent magnet can be positioned between the first arm of the armature and one tine of the stator, and a second permanent magnet can be positioned between the second arm of the armature and the other tine of the stator. For example, in one embodiment, the first permanent magnet is attached to the first arm of the armature and disposed over one tine of the stator and the second permanent magnet is attached to the second arm of the armature and disposed over the other tine of the stator. In another embodiment, the first permanent magnet is attached to one tine of the stator and the second permanent magnet is attached to the other tine of the stator. The coil produces a first magnetic flux when a current is applied to the coil and the magnetic flux of the coil can increase a magnetic flux of one permanent magnet to produce motion in the movable armature in a direction of the increased magnetic flux.

In another aspect, a polarized electromagnetic actuator can include a stator including two tines extending out from the stator and a coil wrapped around the stator between the two tines. A movable armature can include a first arm disposed over one tine and of the stator, a second arm disposed under the other tine of the stator, and a body disposed between the two tines. A first permanent magnet can be attached to one tine of the stator and a second permanent magnet can be attached to the other tine of the stator. The coil produces a first magnetic flux when a current is applied to the coil and the magnetic flux of the coil can increase a magnetic flux of one permanent magnet to produce motion in the movable armature in a direction of the increased magnetic flux.

In another aspect, a method for providing a polarized electromagnetic actuator includes providing a movable armature and a stator, providing at least one coil wrapped around the stator, and providing at least one permanent magnet over the stator. The at least one coil is configured to reduce a magnetic flux of at least one permanent magnet in one direction and increase a magnetic flux of at least one permanent magnet in another direction when a current is applied to the at least one coil to move the movable armature in the direction of the increased magnetic flux.

And in yet another aspect, a polarized electromagnetic actuator includes a movable armature, a stator, at least one coil wrapped around the stator, and at least one permanent magnet disposed over the stator. A method for operating the polarized electromagnetic actuator includes applying a current to the at least one coil to produce a first magnetic flux that reduces a second magnetic flux of at least one permanent magnet in a first direction and increases the second magnetic flux of at least one permanent magnet in a second direction to move the movable armature in the second direction. The current to the at least one coil can be controllably varied to adjust a force applied to the movable armature.

BRIEF DESCRIPTION OF THE DRAWINGS

Embodiments are better understood with reference to the following drawings. The elements of the drawings are not necessarily to scale relative to each other. Identical reference numerals have been used, where possible, to designate identical features that are common to the figures.

DETAILED DESCRIPTION

Figure 1:
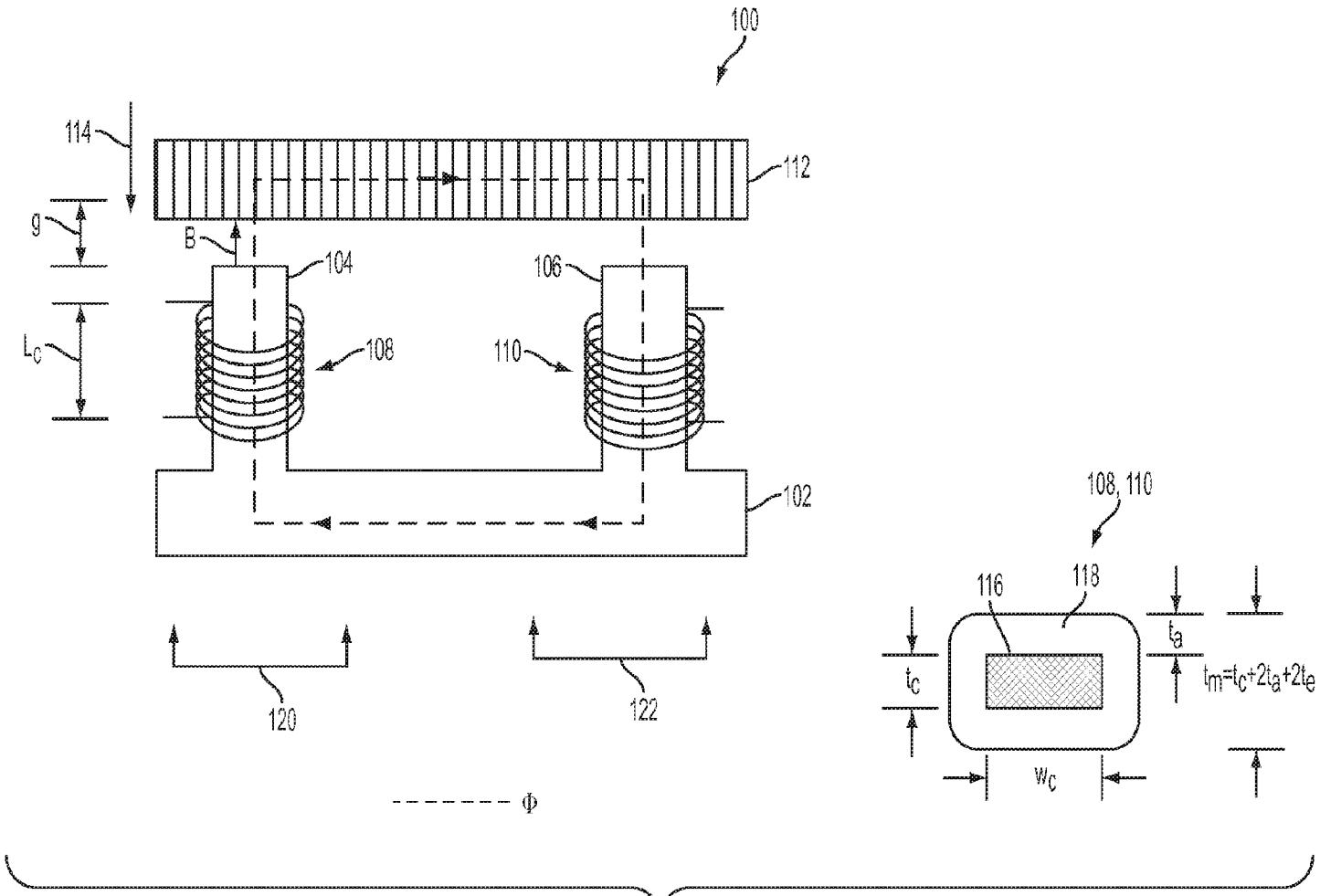
FIG. 1 is a simplified illustration of one example of a prior art electromagnetic actuator.

Embodiments described herein provide a polarized electromagnetic actuator that includes a movable armature spaced apart from a stator. One or more permanent magnets can be disposed over the stator, and one or more coils can be wrapped around the stator. The polarized electromagnetic actuator can generate a greater amount of force by increasing a magnetic flux of a permanent magnet using a magnetic flux produced by one or more coils. For example, in one embodiment, a permanent magnet provides a background magnetic field and flux that are distributed evenly through an armature and a stator. Two coils wrapped around either the stator or the armature produces a magnetic field and flux in a given direction when a current is applied to the coil. The direction of the coil magnetic flux is dependent upon the direction of the current flowing through the coils. The magnetic flux of the coil reduces or cancels the magnetic flux of the permanent magnet in one direction and increases the magnetic flux of the permanent magnet in another direction. The increased magnetic flux of the permanent magnet applies a force to the armature to move the armature in a direction of the increased magnetic flux.

The amount of force applied to the armature can be controlled by controlling the current flowing through the coil or coils. The applied force can be increased by increasing the current, or the amount of force can be decreased by decreasing the current. In some embodiments, the magnetic flux of the coil or coils completely cancels a magnetic flux of a permanent magnet in a first direction. In some embodiments, the amount of force applied to the armature can increase or decrease linearly by varying the current applied to the coil(s).

In some embodiments, the magnetic forces can cause a destabilizing force on the armature similar to a negative spring. This destabilizing force causes the armature to be attracted to one of the tines. One or more stabilizing elements can be included with the polarized electromagnetic actuators to stabilize the armature when a current is not applied to the coil or coils. The stabilizing element or elements can compensate for the destabilizing force. Examples of stabilizing elements include, but are not limited to, springs, flexible structures, or gel packs or disks that can be positioned between the armature and the stator to assist in stabilizing the armature.

Embodiments of polarized electromagnetic actuators can be included in any type of device. For example, acoustical systems such as headphones and speakers, computing systems, haptic systems, and robotic devices can include one or more polarized electromagnetic actuators. Haptic systems can be included in computing devices, digital media players, input devices such as buttons, trackpads, and scroll wheels, smart telephones, and other portable electronic devices to provide tactile feedback to a user. For example, the tactile feedback can take the form of an applied force, a vibration, or a motion. One or more polarized electromagnetic actuators can be included in a haptic system to enable the tactile feedback (e.g., motion) that is applied to the user.

For example, the top surface of a trackpad can be disposed over the top surface of a movable armature of a polarized electromagnetic actuator, or the top surface of the trackpad can be the top surface of the movable armature. The actuator can be included under the top surface of the trackpad. One or more polarized electromagnetic actuators can be included in the trackpad. The polarized electromagnetic actuators can be positioned in the same direction or in different directions. For example, one polarized electromagnetic actuator can provide motion along an x-axis while a second polarized electromagnetic actuator provides motion along a y-axis.

Other embodiments switch the roles of the armature and the stator so that a polarized electromagnetic actuator includes an armature spaced apart from a movable stator. One or more permanent magnets can be disposed over the armature, and one or more coils can be wrapped around the armature. A magnetic field and flux are produced in a given direction when a current is applied to one or more coils. The direction of the coil magnetic flux is dependent upon the direction of the current flowing through the coils. The magnetic flux of the coil reduces or cancels the magnetic flux of the permanent magnet in one direction and increases the magnetic flux of the permanent magnet in another direction. Similarly, one or more stabilizing elements can be included with the polarized electromagnetic actuators to stabilize the armature when a current is not applied to the coil or coils.

Referring now to FIG. 1, there is shown a simplified illustration of one example of a prior art electromagnetic actuator. The actuator 100 includes a stator 102 having two tines 104, 106 that extend out from the stator 102 to form a "U" shaped region. A solenoid or helical coil 108, 110 is wrapped around each tine 104, 106. A movable armature 112 is arranged in a spaced-apart relationship to the tines 104, 106 of the stator 102. The stator 102 and the movable armature 112 can be made of any suitable ferromagnetic material, compound, or alloy, such as steel, iron, and nickel.

Each respective coil and tine forms an electromagnet. An electromagnet is a type of magnet in which a magnetic field is produced by a flow of electric current. The magnetic field disappears when the current is turned off. In the embodiment shown in FIG. 1, a magnetic field B and a magnetic flux $\phi$ are produced when current flows through the coils 108, 110. In FIG. 1, the magnetic field B is represented by one magnetic field arrow and the magnetic flux $\phi$ is represented by one flux line.

The force produced by the magnetic field B can be controlled by controlling the amount of electric current (I) flowing through the coils 108, 110 in that the force varies according to the equation $I^2$. The force is attractive and causes the armature 112 to be pulled downwards towards both tines 104, 106 (movement represented by arrow 114). Assuming the core is not saturated and does not contribute significantly to the overall reluctance, and assuming no significant fringing fields in the air gap g, the force (F) exerted by the electromagnets (i.e., tine 104 and coil 108; tine 106 and coil 110) can be determined by the following equation, $$F = \frac{\mu_0 \pi^2 V^2 D^4 w_c t_c}{256 \rho^2 g^2 (w_c + t_m - 2t_e)^2} \qquad \text{Equation 1}$$

where $\mu_0$ is the permeability of free space or air, V is the applied voltage, D is the wire diameter (total), $w_c$ is the core width of the coil (see FIG. 1), $t_c$ is the core thickness of the coil, $\rho$ is the effective resistivity of the coil, g is the gap between the armature 112 and the tines 104, 106, $t_m$ is the maximum allowable thickness of the coil, and $t_e$ is the encapsulation thickness of the coil.

The force (F) divided by the power (P) for the electromagnets can be calculated by $$\frac{F}{P} = \frac{\mu_0 \pi L_c w_c t_c t_a}{16 \rho g^2 (w_c + t_m - 2t_e)} \qquad \text{Equation 2}$$

where $\mu_0$ is the permeability of free space or air, $L_c$ is the length of the coil, $w_c$ is the core width of the coil, $t_c$ is the core thickness of the coil, $t_a$ is the thickness of the wire coil, $\rho$ is the effective resistivity of the coil, g is the gap between the armature 112 and the tines 104, 106, $t_m$ is the maximum allowable thickness of the coil, and $t_e$ is the encapsulation thickness of the coil.

One limitation to the actuator 100 is that the force can produce motion in only one direction, such that the armature 112 can only be pulled down toward the tines 104, 106. Additionally, the overall efficiency for the actuator 100 can be low. For example, in some embodiments, the overall efficiency of the actuator can be 1.3%. One reason for the reduced efficient is saturation, but the non-linear effects of the gap g can somewhat offset the reduced efficiency in some embodiments.

Figure 2:
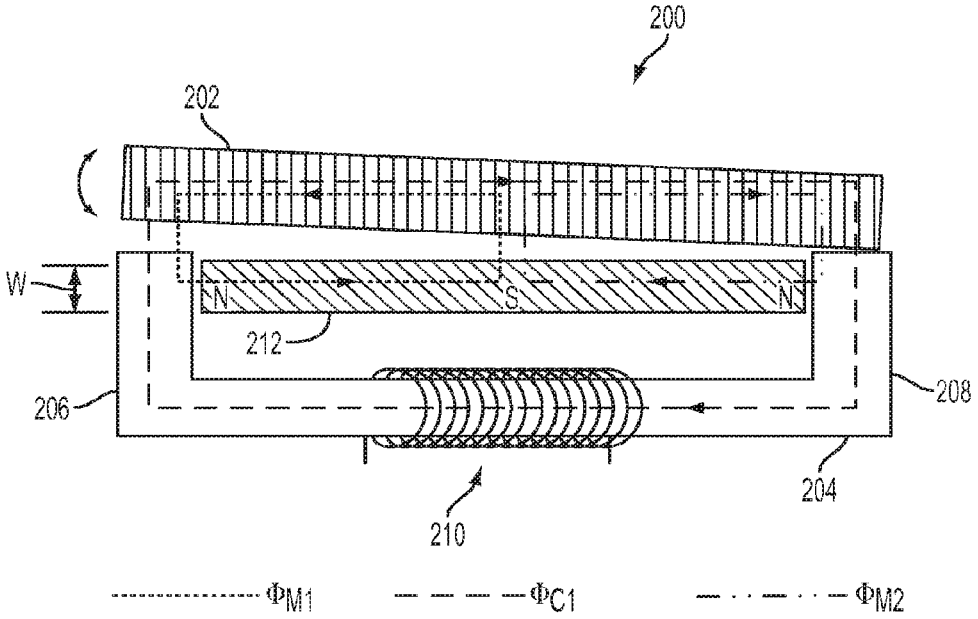
FIG. 2 is a simplified illustration of another example of a prior art electromagnetic actuator.

Referring now to FIG. 2, there is shown a simplified illustration of another example of a prior art electromagnetic actuator. The actuator 200 includes a movable armature 202 and a stator 204 held in a spaced-apart relationship to the armature 202. The stator 204 includes two tines 206, 208 extending out such that the stator 204 is formed into a "U" shape. A helical coil 210 is wrapped around the stator 204 between the tines 206, 208. When a current flows through the coil 210, a magnetic flux $\phi C$ is created that travels through the movable armature 202 and around the stator 204 through the tines 206, 208. The direction of travel of the coil magnetic flux $\phi C$ depends on the direction of the current passing through the coil 210.

A magnet 212 is disposed between the two tines 206, 208 below the armature 202. The magnet 212 typically has a relatively small width W. The magnet 212 is polarized with two north poles on the outer edges of the magnet and a single south pole in the center. The flux from the south pole traverses a small air gap to the armature 202 and then propagates through the armature to the upper corner of the stator 204 and back through the magnet 212. The flux from the coil 210 interacts with the flux from the magnet 212 to produce a net torque on the armature. Relay contact arms (not shown) act as flexures that stabilize the negative spring constant of the magnetic field of the magnet 212.

The double pole magnet 212 can be difficult to produce. Additionally, the illustrated actuator typically works well for a relay, but the force produced by the actuator is limited by the width W of the magnet 212. It can be desirable to use an actuator that can produce larger forces in other types of applications and/or devices. By way of example only, other embodiments can use an actuator that creates a more powerful force that is able to produce a haptic response in a device, such as in a trackpad or other similar device.

Figure 3:
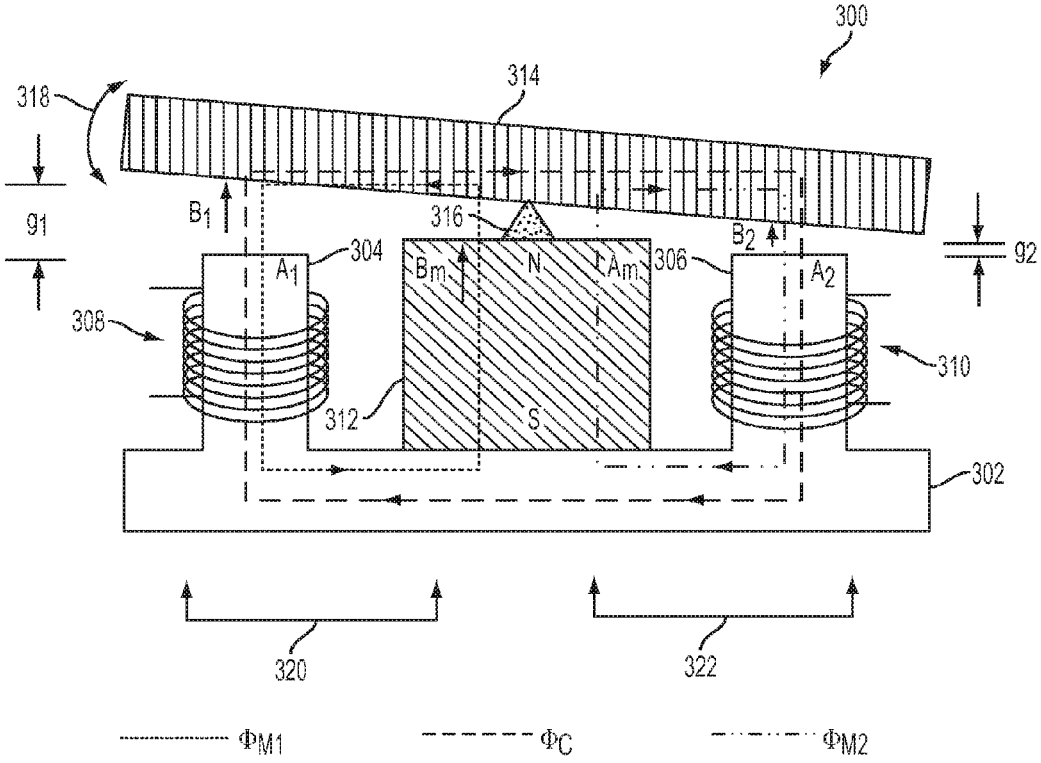
FIG. 3 is a simplified illustration of a first example of a polarized electromagnetic actuator.

Embodiments described herein provide a polarized electromagnetic actuator that is more efficient, can produce a greater amount of force for the same applied current, and can produce a controllable motion in two directions (e.g., push and pull). FIG. 3 is a simplified illustration of a first example of a polarized electromagnetic actuator. The actuator 300 includes a stator 302 with two tines 304, 306 extending out to form a "U" shaped region of the stator 302. A helical coil 308, 310 is wrapped around each tine 304, 306 and a permanent magnet 312 is positioned between the tines 304, 306. A movable armature 314 is arranged in a spaced-apart relationship to the tines of the stator 302 and disposed over a pivot 316.

In the illustrated embodiment, the stator 302 and the movable armature 314 can be made of any suitable ferromagnetic material, compound, or alloy, such as steel, iron, and nickel. The permanent magnet 312 can be any suitable type of permanent magnet, including, but not limited to, a neodymium (NdFeB) magnet. A ferromagnetic material is a material that can be magnetized. Unlike a ferromagnetic material, a permanent magnet is made of a magnetized material that produces a persistent magnetic field. In FIG. 3, the permanent magnet 312 produces a magnetic field B that is distributed evenly through each stator tine 304, 306 when the gaps $g_1$ and $g_2$ are equal. The magnetic flux $\phi_{M1}$, $\phi_{M2}$ associated with the permanent magnet 312 provides a background magnetic flux traveling through the movable armature 314 and the stator 302 (including the tines 304, 306). When a current flows through the coils 308, 310, a magnetic flux $\phi_C$ is created that travels through the movable armature 314 and around the stator 302 through the tines 304, 306, but substantially not through the permanent magnet 312. The direction of travel of the coil magnetic flux $\phi_C$ depends on the direction of the current passing through the coils 308, 310.

The magnetic flux $\phi_C$ produced by the coils 308, 310 interacts with the magnetic flux $\phi_{M1}$, $\phi_{M2}$ of the permanent magnet to reduce or cancel the magnetic flux in one direction ($\phi_{M1}$ or $\phi_{M2}$) and increase the magnetic flux in the other direction. Motion is produced in the movable armature 314 in the direction of the increased magnetic flux ($\phi_{M1}$ or $\phi_{M2}$). For example, in the illustrated embodiment, the coil magnetic flux $\phi_C$ is traveling in a direction that opposes the direction of the magnetic flux $\phi_{M1}$, thereby reducing or canceling the magnetic flux $\phi_{M1}$. Concurrently, the coil magnetic flux $\phi_C$ is traveling in the same direction as the direction of the magnetic flux $\phi_{M2}$, thereby increasing the magnetic flux $\phi_{M2}$. The armature 314 moves up and down like a teeter-totter based on the force applied to the armature (movement represented by arrow 318). The movable armature 314 can be pulled toward a respective tine or pushed away from a respective tine depending on the direction of the current through the coils 308, 310. Additionally, the amount of force applied to the armature can be controlled by controlling the amount of current applied to the coils 308, 310.

Ampere's Law $\nabla\times H=J$ and Maxwell's Equation $\nabla\cdot B=0$ can be used to analyze the illustrated actuator 300. Note that the following analysis assumes the core does not saturate and that no fringing fields are present in the gaps $g_1$ and $g_2$.

$$\nabla\times H=J:\ H_1g_1-H_mL_m=NI_1;\ \text{and} \qquad \text{Equation 3}$$

$$H_mL_m-H_2g_2=NI_2 \qquad \text{Equation 4}$$

$$\nabla\cdot B=0:\ B_1A_1+B_mA_m+B_2A_2=0 \qquad \text{Equation 5}$$

where $L_m$ is the length of the permanent magnet 312, N is the number of turns in each coil 308, 310, and $H_1$, $H_2$, and $H_m$ are the H fields (magnetic strength) associated with the magnetic fields $B_1$, $B_2$, and $B_m$, respectively. Another equation included in the analysis is the relationship between the magnetic field B and the H field in the permanent magnet, also known as the demagnetization curve. Magnet suppliers typically provide a demagnetization curve for each of the materials used in the permanent magnets. Typically, the relationship between B and H is linear and can be approximated as follows, $$B_m=B_r+\mu_0H_m \qquad \text{Equation 6}$$

where $B_r$ is the remanent magnetization of the permanent magnet (e.g., ~1.2 T). Solving equations 3 through 6, the magnetic force $B_1$ and $B_2$ can be determined by $$B_1=\left(\frac{1}{A_1+A_mg_1/L_m+A_2g_1/g_2}\right)\left(-B_rA_m+\left(\frac{A_m}{L_m}\right)(\mu_0NI_1)+\left(\frac{A_2}{g_2}\right)(\mu_0N(I_1+I_2))\right) \qquad \text{Equation 7}$$

$$B_2=\left(\frac{1}{g_2}\right)(B_1g_1-\mu_0N(I_1+I_2)) \qquad \text{Equation 8}$$

As described earlier, the magnetic flux $\phi_C$ produced by the coils 308, 310 interacts with the magnetic flux $\phi_{M1}$, $\phi_{M2}$ of the permanent magnet to reduce or cancel one magnetic flux ($\phi_{M1}$ or $\phi_{M2}$) and increase the other magnetic flux. When the magnetic flux $\phi_C$ cancels a magnetic flux in one direction ($\phi_{M1}$ or $\phi_{M2}$) completely, the magnetic field of the coil $B_{coil}$ equals the magnetic field in the permanent magnet $B_{magnet}$, and the force is increased. By way of example only, in the illustrated embodiment, when the magnetic field of the coil $B_{coil}$ equals the magnetic field in the permanent magnet $B_{magnet}$, the force produced by the left-hand side 320 of the actuator 300 can be determined by $$F_{320}=\frac{1}{2\mu_0}(B_{coil}-B_{magnet})^2A_{core}=0 \qquad \text{Equation 9}$$

Also, when the magnetic field of the coil $B_{coil}$ equals the magnetic field in the permanent magnet $B_{magnet}$, the force produced by the right-hand side 322 of the actuator 300 can be calculated by $$F_{322}=\frac{1}{2\mu_0}(B_{coil}+B_{magnet})^2A_{core}=\frac{4}{2\mu_0}(B_{coil})^2A_{core} \qquad \text{Equation 10}$$

In comparison, the amount of force generated by the left-hand side 120 and right-hand side 122 of the actuator 100 shown in FIG. 1 can be defined by $$F_{TOTAL}=F_{120}+F_{122}=\frac{2}{2\mu_0}(B_{coil})^2A_{core} \qquad \text{Equation 11}$$

Thus, the actuator 300 in FIG. 3 can generate more force than the actuator 100 in FIG. 1. The actuator 300 in FIG. 3 can produce a magnetic force $B_{magnet}>B_{coil}$, which means a smaller $B_{coil}$ can be produced to obtain the same amount of force as the actuator 100 in FIG. 1. In the event that the coil produces the same size field as the permanent magnet ($B_{coil}=B_{magnet}$), then equations 10 and 11 above demonstrate that the polarized actuator produces twice the force of a conventional actuator. In some situations, the field produced by the coil is less than the field produced by the permanent magnet, in which case the polarized actuator produces more than twice the force of a conventional actuator.

Figure 4:
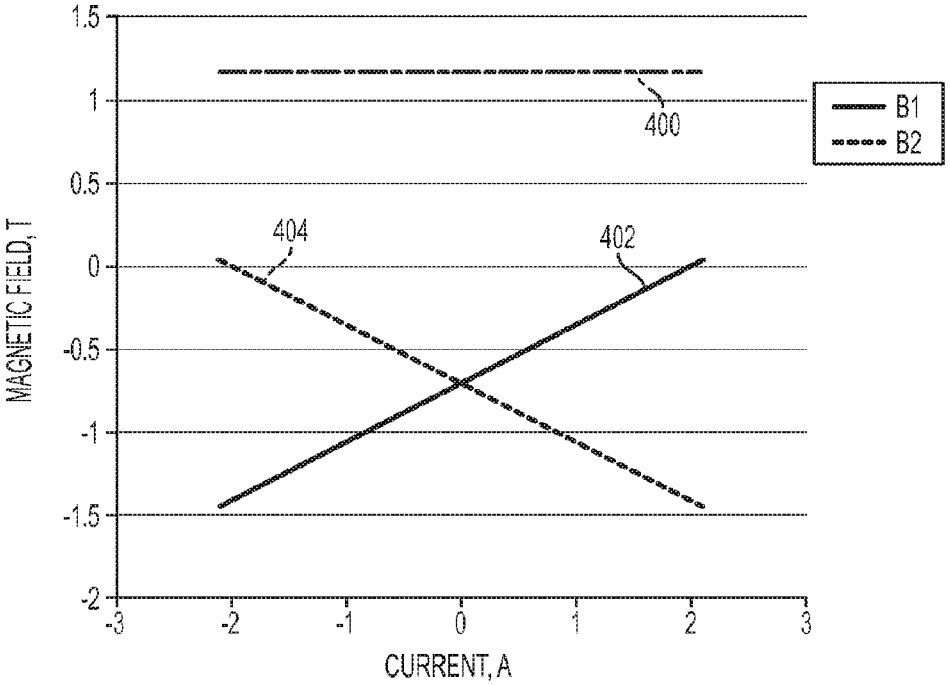
FIG. 4 depicts an example graph of the magnetic fields $B_1$ and $B_2$ versus an applied current for the polarized electromagnetic actuator shown in FIG. 3.

FIG. 4 is an example graph of the magnetic fields $B_1$ and $B_2$ versus an applied current for the polarized electromagnetic actuator shown in FIG. 3. Plot 400 represents the applied current to the coils 308, 310 as it changes between approximately −2 amps and +2 amps. In the illustrated embodiment, the magnetic field $B_1$ increases linearly (plot 402) and the magnetic field $B_2$ decreases linearly (plot 404) as the current applied to the coils 308, 310 increases from −2 amps to +2 amps.

Figure 5:
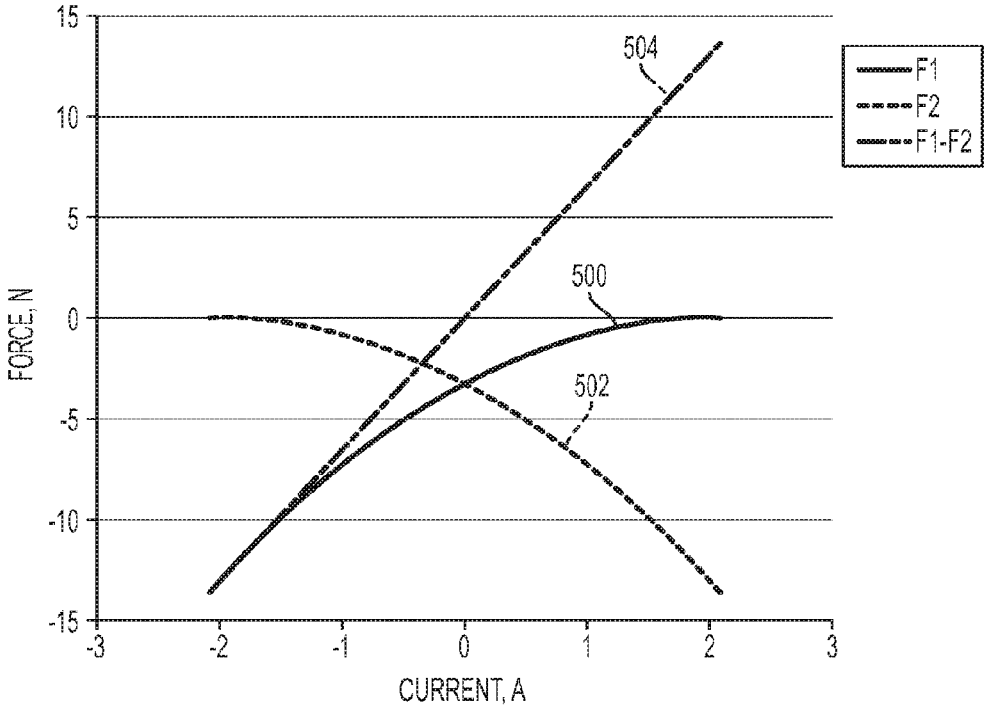
FIG. 5 illustrates an example graph of the forces varying with an applied current for the polarized electromagnetic actuator shown in FIG. 3.

Similarly, the total force produced by the magnetic fields varies linearly with the applied current. FIG. 5 illustrates an example graph of the forces varying with an applied current for the polarized electromagnetic actuator shown in FIG. 3. In the illustrated embodiment, the force $F_1$ produced by the magnetic field $B_1$ (plot 500) increases with the current applied to the coils while the force $F_2$ produced by the magnetic field $B_2$ (plot 502) decreases with the applied current. The resulting total force $F_1$-$F_2$ increases linearly as the current applied to the coils 308, 310 increases from −2 amps to +2 amps, as shown in plot 504.

Figure 6:
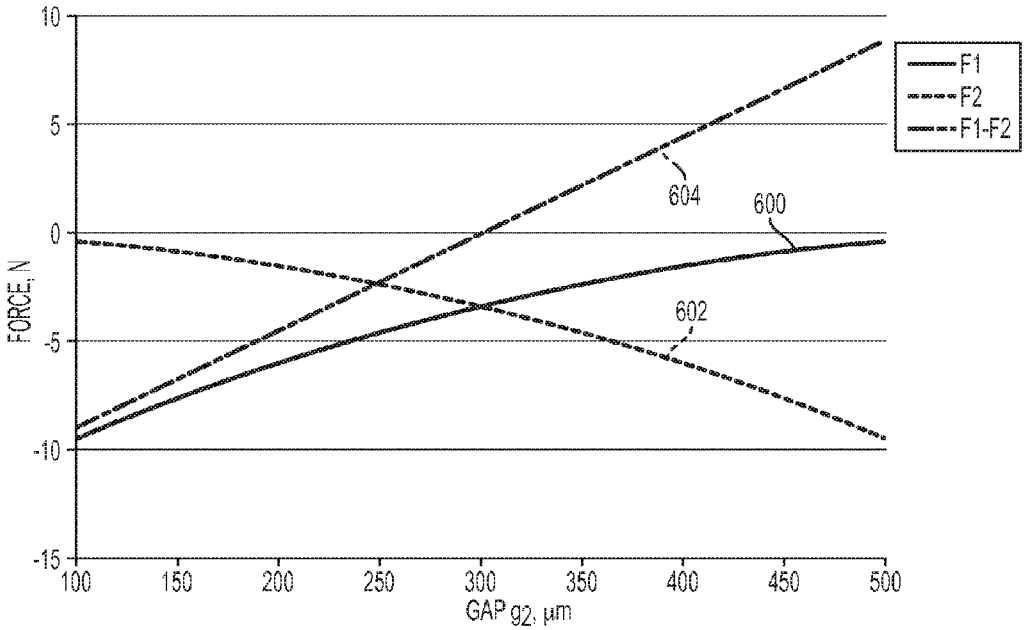
FIG. 6 depicts an example graph of the forces versus armature position for the polarized electromagnetic actuator shown in FIG. 3.

The resulting total force $F_1$-$F_2$ can also vary linearly with armature position. As shown in FIG. 6, as the gap $g_2$ increases, the force $F_2$ produced by the magnetic field $B_2$ decreases. Since the armature 314 pivots around a point central to the two tines 304 and 306, increasing gap $g_2$ causes gap $g_1$ to decrease. As $g_1$ decreases the force $F_1$ produced by the magnetic field $B_1$ increases. The net force $F_1$-$F_2$ thus increases with increasing gap $g_2$. Detailed modeling of the magnetic fields $B_1$ and $B_2$ demonstrate that this increase in net force is approximately linear with $g_2$.

The polarized electromagnetic actuator 300 can have a higher overall efficiency than the actuator 100 of FIG. 1. As described above, the actuator 300 can generate more force at the same current compared to the actuator 100 in FIG. 1. Moreover, the total force varies linearly with the applied current for the actuator 300, so the actuator 300 provides linear control of the total force. In comparison, the total force of actuator 100 (FIG. 1) is approximately equal to the square of the current.

Additionally, including the permanent magnet 312 in the actuator 300 can reduce power consumption of the actuator 300. The force is driven by the magnetic field from the permanent magnet 312. So a fairly substantial force can be generated by the actuator 300 even when the amount of current flowing through the coils 308, 310 is relatively small. With the prior art actuator 100 shown in FIG. 1, a small or negligible amount of force is generated when a small amount of current is flowing through the coils 108, 110.

The permanent magnet 312 can be easier to manufacture compared to the magnet 212 shown in FIG. 2 because the permanent magnet 312 has a single set of north and south poles compared to the magnet 212 that has a single south pole and two north poles. Additionally, the permanent magnet 312 can be relatively shorter and wider than the relatively thinner and longer magnet 212. The shorter and wider permanent magnet 312 may provide improved volume efficiency compared to the magnet 212.

Figure 7:
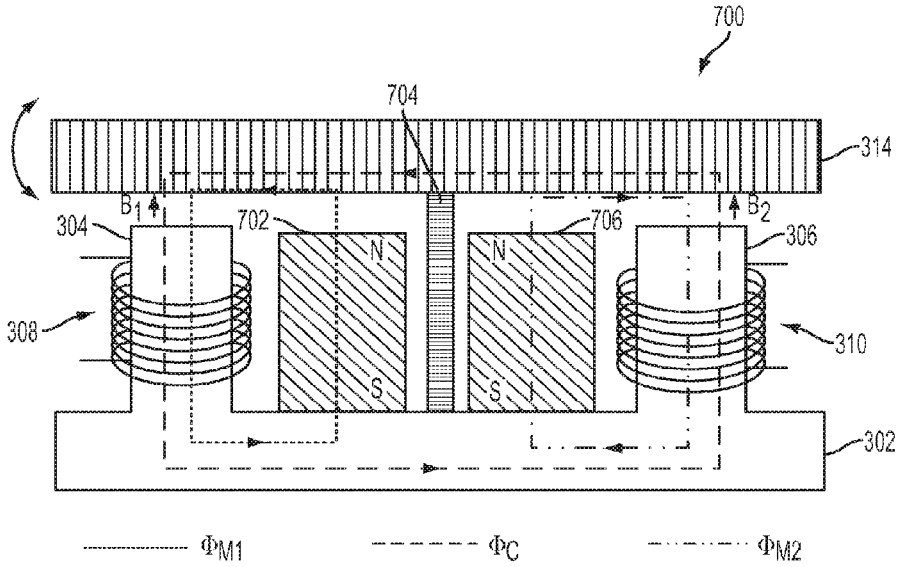
FIG. 7 is a simplified illustration of a second example of a polarized electromagnetic actuator.

Referring now to FIG. 7, there is shown a simplified illustration of a second example of a polarized electromagnetic actuator. The actuator 700 includes many of the same elements shown in FIG. 3, and as such these elements will not be described in more detail herein. A first permanent magnet 702 is positioned between the tine 304 and a pivot 704. A second permanent magnet 706 is disposed between the pivot 704 and the tine 306. The pivot 704 can provide a restoring force to the armature 314 so the armature naturally re-centers itself when the current in the coils 308, 310 is turned off.

Like the embodiment shown in FIG. 3, the magnetic flux $\phi_C$ produced by the coils 308, 310 interacts with the magnetic flux $\phi_{M1}$, $\phi_{M2}$ of the permanent magnets to reduce or cancel one magnetic flux in one direction $\phi_{M1}$ or $\phi_{M2}$) and increase the magnetic flux in the other direction. Motion is produced in the direction of the increased magnetic flux.

For example, in the illustrated embodiment, the coil magnetic flux $\phi_C$ is traveling in a direction that opposes the direction of the magnetic flux $\phi_{M2}$, thereby reducing or canceling the magnetic flux $\phi_{M2}$. Concurrently, the coil magnetic flux $\phi_C$ is traveling in the same direction as the direction of the magnetic flux $\phi_{M1}$, thereby increasing the magnetic flux $\phi_{M1}$. The armature 314 moves up and down (e.g., like a teeter-totter) based on the force applied to the movable armature. The movable armature 314 can be pulled toward a respective tine or pushed away from a respective tine depending on the direction of the current through the coils 308, 310. Additionally, the amount of applied force can be controlled by controlling the amount of current flowing through the coils 308, 310.

In some embodiments, the movable armature can be in an unstable equilibrium when a current is not applied to the coils. In such embodiments, one or more stabilizing elements can stabilize the armature using a restoring force to prevent the armature from moving to one of the two contacts. In FIG. 7, the pivot 704 can provide a restoring force that stabilizes the movable armature 314. With the actuator 300 shown in FIG. 3, the armature 314 can be stabilized with one or more springs or gel disks placed between the armature 314 and the stator 302. Other embodiments can design the armature 314 to saturate at large fields and limit the growth of the force, or the armature can be designed to move in only one direction in the absence of a current through the coils, and a stop can be provided in the one direction of movement. Alternatively, the stator can be designed to include an additional non-force generating flux path.

Figure 8:
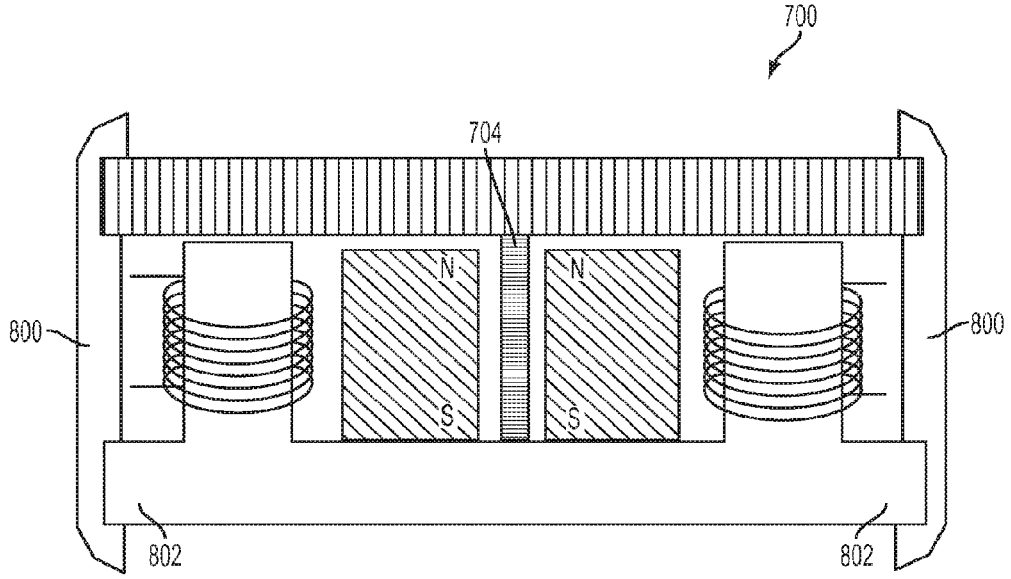
FIG. 8 illustrates one method for providing a restoring force to the polarized electromagnetic actuator shown in FIG. 7.

With respect to the actuators shown in FIGS. 3 and 7, one method for providing a restoring force to the actuators 300, 700 is illustrated in FIG. 8. Stabilizing elements 800, such as C-springs, are provided around the ends of the movable armature 314 and the protrusions 802 of the stator 302 to restrict or limit the movement of the armature 314. By way of example only, the space between the armature 314 and the tines 304, 306 can be 300 microns. The movable armature 314 can therefore only move 300 microns in any one direction when the stabilizing elements 800 are placed over the ends of the actuator 700.

Although the FIG. 7 actuator 700 is used to depict the stabilizing elements 800, those skilled in the art will recognize that the stabilizing elements 800 can be used with the actuator 300 shown in FIG. 3.

Figure 9:
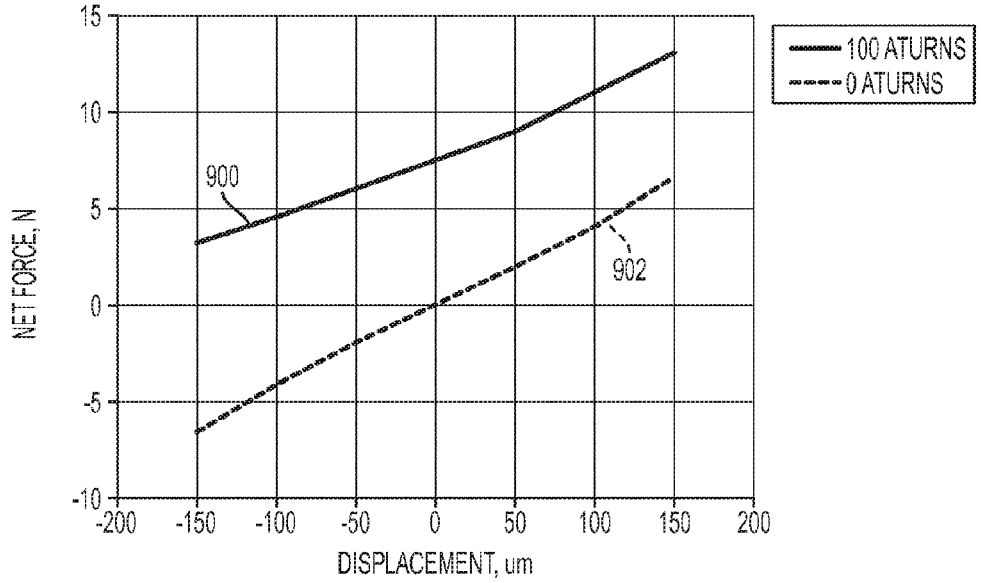
FIG. 9 depicts an example graph of the armature displacement in the actuator 200 shown in FIG. 3.
Figure 10:
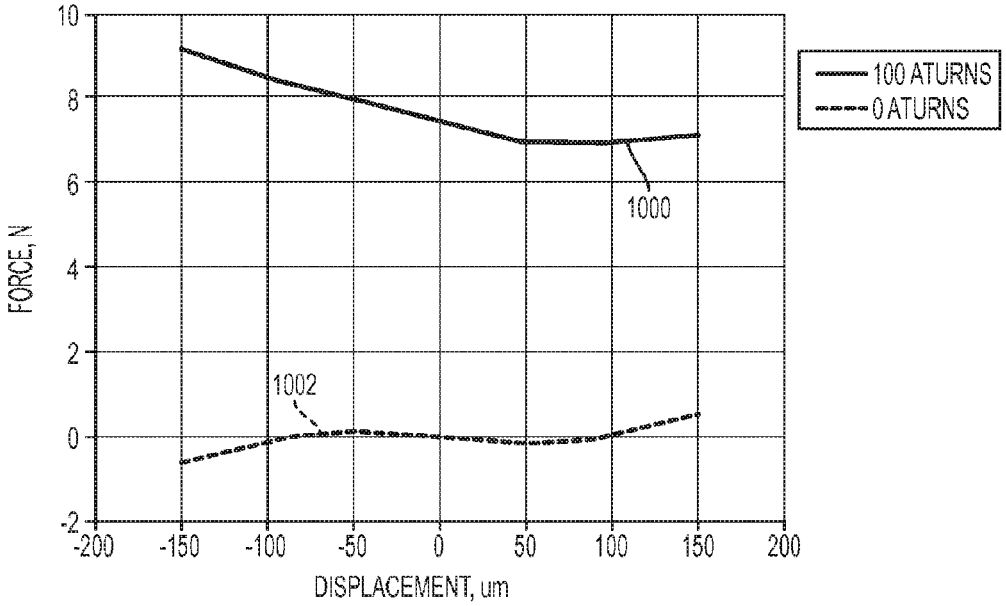
FIG. 10 illustrates an example graph of the armature displacement in the actuator 600 shown in FIG. 8.

FIG. 9 illustrates an example graph of the applied force as a function of armature displacement for the actuator 300 shown in FIG. 3, while FIG. 10 depicts an example graph of the applied force as a function of armature displacement for the actuator 700 shown in FIG. 8. In FIG. 9, plot 900 represents the applied force as a function of armature displacement when 100 Ampere-turns (Aturns) is applied to each coil 308, 310. Plot 902 represents the applied force as a function of armature displacement when 0 Aturns is applied to each coil 308, 310. When a current is not applied to the coils 308, 310, the applied force ranges between approximately −6 N and +6 N as the armature is displaced between −150 and +150 microns. Since plot 902 has a positive slope, the armature is in unstable equilibrium at zero displacement. Once the armature is displaced incrementally away from the origin in either direction, it will accelerate in that direction until it reaches the end of travel.

In contrast, the stabilizing elements 800 can limit the applied force within the same armature displacement. When a current is not applied to the coils 308, 310, plot 1002 of FIG. 10 represents the applied force as a function of armature displacement when 0 Aturns is applied to each coil 308, 310. As shown, with the stabilizing elements 800, the applied force ranges between approximately −1 N and +1 N as the armature 314 is displaced between −150 and +150 microns. The addition of the stabilizing elements 800 causes the force to have a negative slope as it passes through the origin. Therefore, the actuator is stable at zero displacement. And the applied force ranges approximately between +9 and +7 when 100 Aturns is applied to each coil 308, 310 (see plot 1000).

Figure 11:
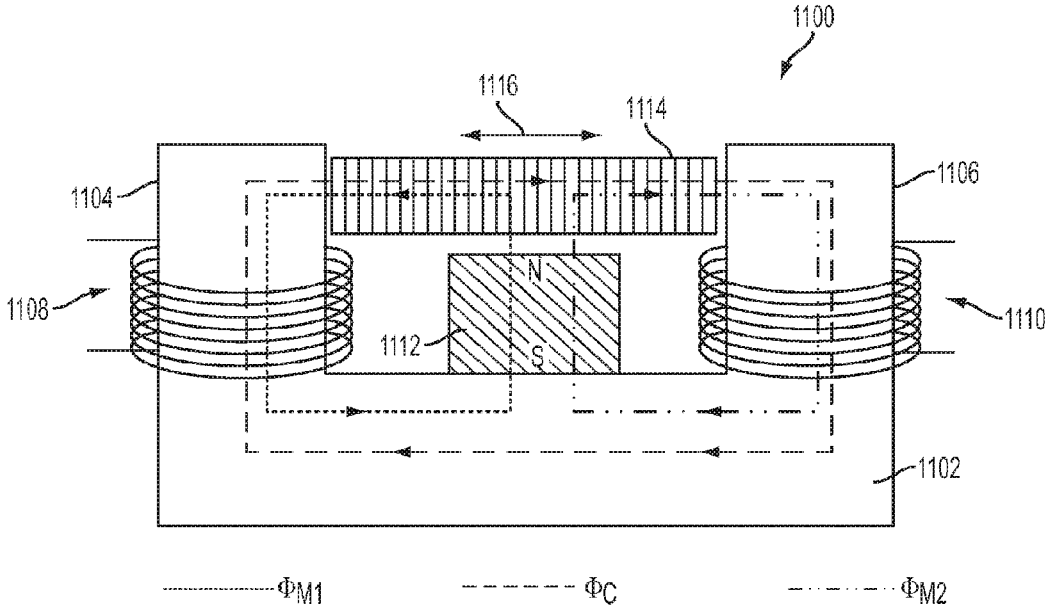
FIG. 11 is a simplified illustration of a third example of a polarized electromagnetic actuator.

Referring now to FIG. 11, there is shown a simplified illustration of a third example of a polarized electromagnetic actuator. The actuator 1100 includes a stator 1102 with two tines 1104, 1106 extending out to form into a "U" shaped region of the stator 1102. A helical coil 1108, 1110 is wrapped around each tine 1104, 1106 and a permanent magnet 1112 is positioned in a spaced-apart relationship to the stator 1102 and the permanent magnet 1112. In the illustrated embodiment, the movable armature 1114 is disposed over the permanent magnet 1112 and within the "U" shaped region between the tines 1104, 1106.

The permanent magnet 1112 can produce a magnetic field B that is distributed evenly through each stator tine 1104, 1106. The magnetic flux $\phi_{M1}$, $\phi_{M2}$ associated with the permanent magnet 1112 provides a background magnetic flux traveling from the permanent magnet 1112 through the armature 1114, the stator 1102 (including the tines 1104, 1106), and back to the permanent magnet 1112. A magnetic flux $\phi_C$ is produced when a current is applied to the coils 1108, 1110. The coil magnetic flux $\phi_C$ travels through the armature 1114 and around the stator 1102 through the tines 1104, 1106, but largely not through the permanent magnet 1112. The direction of travel of the coil magnetic flux $\phi_C$ depends on the direction of the current passing through the coils 1108, 1110.

The magnetic flux produced by the coils 1108, 1110 reduces or cancels the magnetic flux in a first direction and increases the magnetic flux in a second direction of the permanent magnet. Motion is produced in the armature in the direction of the increased magnetic flux. The armature 1114 moves left and right based on the force applied to the armature (movement represented by arrow 1116). The movable armature 1114 can be pulled toward a respective tine or pushed away from a respective tine depending on the direction of the current through the coils 1108, 1110. Additionally, the amount of force applied to the movable armature 1114 can be controlled by controlling the amount of current applied to the coils 1108, 1110.

Figure 12:
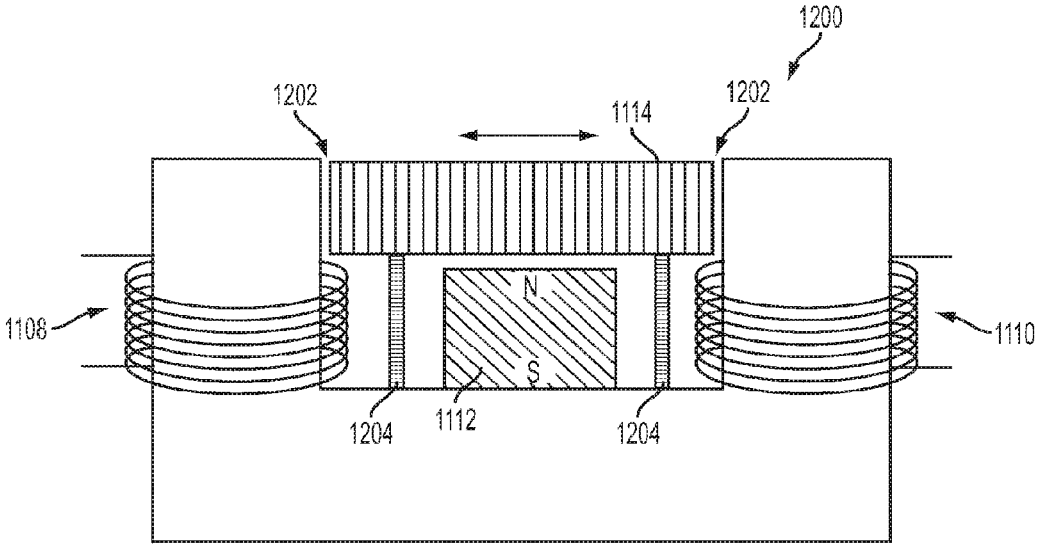
FIG. 12 depicts a first method for providing a restoring force to the polarized electromagnetic actuator shown in FIG. 11.

FIG. 12 depicts a first method for providing a restoring force to the polarized electromagnetic actuator shown in FIG. 11. The actuator 1200 includes many of the same elements shown in FIG. 11, and as such these elements will not be described in more detail in the description of FIG. 12. As described earlier, when a current flows through the coils 1108, 1110, the magnetic field from the coils interacts with the magnetic field from the permanent magnet 1112 and increases the field on one side of the armature 1114 and decreases the field on the other side of the armature. When a current is not applied to the coils 1108, 1110, there can be equal and opposite forces on the left and right sides of the armature 1114 across the gap 1202. There can also be a force attraction between the permanent magnet 1112 and the armature 1114. Bending flexures 1204 act as stabilizing elements by counteracting the attraction between the permanent magnet 1112 and the armature 1114. The spring constants of the bending flexures 1204 can stabilize the armature 1114 in the center of its travel. Other embodiments can include a fewer or greater number of stabilizing elements.

Figure 13:
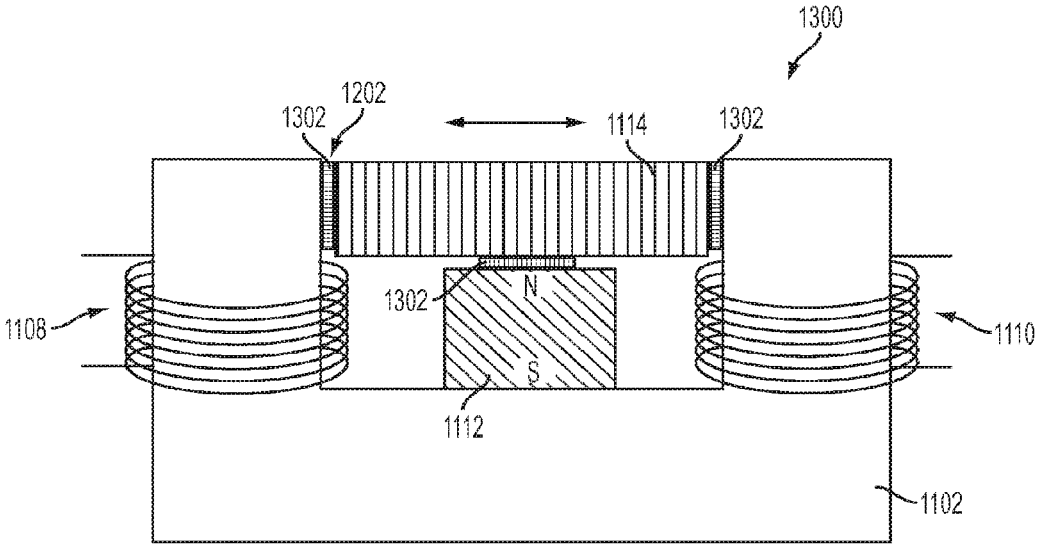
FIG. 13 illustrates a second method for providing a restoring force to the polarized electromagnetic actuator shown in FIG. 11.

FIG. 13 illustrates a second method for providing a restoring force to the polarized electromagnetic actuator shown in FIG. 11. Like the embodiment shown in FIG. 12, there can be equal and opposite forces on the left and right sides of the armature 1114 across the gap 1202 when a current is not applied to the coils 1108, 1110. There is also a force attraction between the permanent magnet 1112 and the armature 1114. The gel disks or pads 1302 act as stabilizing elements by stabilizing the armature 1114 in the spaces between the stator 1102 and the permanent magnet 1112. Other embodiments can include a fewer or greater number of stabilizing elements.

Figure 14:
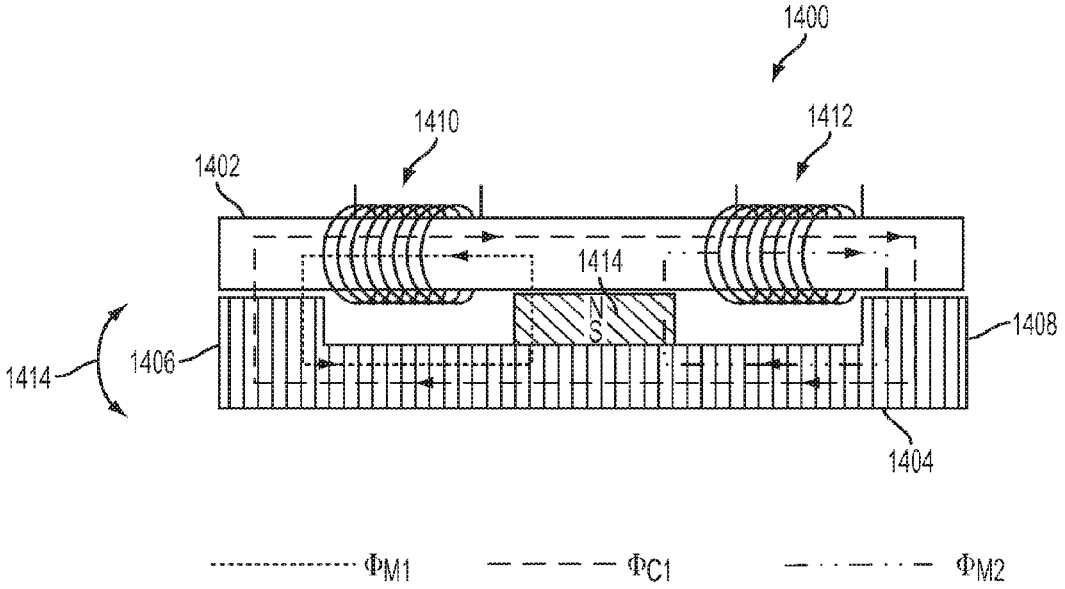
FIG. 14 is a simplified illustration of a fourth example of a polarized electromagnetic actuator.

Referring now to FIG. 14, there is shown a simplified illustration of a fourth example of a polarized electromagnetic actuator. The actuator 1400 includes a rectangular-shaped stator 1402 and a movable armature 1404 held in a spaced-apart relationship to the stator 1402. The movable armature 1404 includes two tines 1406, 1408 extending out to form a "U" shaped region of the armature 1404. A first helical coil 1410 is wrapped around one end of the stator 1402 between the tines 1406, 1408 and a second helical coil 1412 is wrapped around the other end of the stator 1402 between the tines 1406, 1408. A permanent magnet 1414 is positioned over the stator 1402 between the two coils 1410, 1412.

The permanent magnet 1414 produces a magnetic flux $\phi_{M1}$, $\phi_{M2}$ that provides a background magnetic flux traveling through the stator 1402 and the movable armature 1404 (including the tines 1406, 1408). A magnetic flux $\phi_C$ is produced by the first and second coils 1410, 1412 when a current is applied to the coils 1410, 1412. The coil magnetic flux $\phi_C$ travels through the armature 1404 (including the tines 1406, 1408) and around the stator 1402 (but largely not through the permanent magnet 1414). The direction of travel of the coil magnetic flux $\phi_C$ depends on the direction of the current passing through the coils 1410, 1412.

The coil magnetic flux $\phi_C$ interacts with a respective magnetic flux $\phi_{M1}$ or $\phi_{M2}$) of the permanent magnet to reduce or cancel the magnetic flux in one direction and increase the magnetic flux in the other direction. For example, in the illustrated embodiment, the coil magnetic flux $\phi_C$ is traveling in a direction that opposes the direction of the magnetic flux $\phi_{M1}$, thereby reducing or canceling the magnetic flux $\phi_{M1}$. Concurrently, the coil magnetic flux $\phi_C$ is traveling in the same direction as the direction of the magnetic flux $\phi_{M2}$, thereby increasing the magnetic flux $\phi_{M2}$. The increase in the magnetic flux $\phi_{M2}$ by the magnetic flux $\phi_{C2}$ increases the force. The armature 1404 moves in the direction of the increased magnetic flux $\phi_{M2}$ based on the force applied to the movable armature.

In the embodiments of FIGS. 3, 7, 8, and 11-14, the coil magnetic flux largely does not pass through the permanent magnet or magnets. This is due to the fact that the permanent magnet(s) appear or act like an air gap when the coil(s) produces a magnetic flux. Since the thickness of the permanent magnets can be much larger than the thicknesses of the air gaps $g_1$ and $g_2$, the path through the magnet is relatively high reluctance and a very small fraction of the coil flux traverses the magnet. In a fifth example of a polarized electromagnetic actuator shown in FIG. 15, the coil magnetic flux does not pass through the permanent magnets and the magnetic fluxes of the permanent magnets does not travel through the coil.

The actuator 1500 includes a stator 1502 with tines 1504, 1506 extending out to form a "U" shaped region of the stator. A helical coil 1508 is wrapped around the stator 1502 between the two tines 1504, 1506. A first permanent magnet 1510 is positioned over the tine 1504 and a second permanent magnet 1512 is disposed over the tine 1506. A movable armature 1514 can be formed in a "T" shape with the arms 1516, 1518 of the T-shaped armature 1514 disposed over the permanent magnet 1510, 1512, respectively. The body of the T-shaped armature 1514 is positioned over the coil 1508 within the "U" shaped region between the tines 1504, 1506. The movable armature 1514 is held in a spaced-apart relationship to the stator 1502 and the permanent magnets 1510, 1512.

The permanent magnet 1510 produces a magnetic flux $\phi_{M1}$ and the permanent magnet 1512 produces a magnetic flux $\phi_{M2}$. The magnetic fluxes $\phi_{M1}$, $\phi_{M2}$ provide a background magnetic flux around respective permanent magnets 1510, 1512 and through the movable armature 1514 (but not through the coil 1508). Additionally, a magnetic flux $\phi_C$ is produced when a current is applied to the coil 1508. The coil magnetic flux $\phi_C$ travels through the body of the T-shaped armature 1514 and around the stator 1502 and tines 1504, 1506, but not (or largely not) through the permanent magnets 1510, 1512. As with the other embodiments, the direction of travel of the coil magnetic flux $\phi_C$ depends on the direction of the current passing through the coil 1508.

The magnetic flux $\phi_C$ produced by the coil 1508 interacts with the magnetic flux $\phi_{M1}$, $\phi_{M2}$ of the permanent magnets 1510, 1512 to reduce or cancel one magnetic flux ($\phi_{M1}$, or $\phi_{M2}$) and increase the other magnetic flux. Motion is produced in the movable armature 1514 in the direction of the increased magnetic flux. The armature 1514 moves in a left direction or in a right direction based on the direction of the increased magnetic flux (movement depicted by arrow 1520). For example, in the illustrated embodiment, the coil magnetic flux $\phi_C$ is traveling in a direction that opposes the direction of the magnetic flux $\phi_{M1}$, thereby reducing or canceling the magnetic flux $\phi_{M1}$. Concurrently, the coil magnetic flux $\phi_C$ is traveling in the same direction as the direction of the magnetic flux $\phi_{M2}$, thereby increasing the magnetic flux $\phi_{M2}$. The increase in the magnetic flux $\phi_{M2}$ by the magnetic flux $\phi_C$ increases the amount of force applied to the movable armature 1514.

As previously described, the armature 1514 moves left or right based on the force applied to the armature (movement represented by arrow 1520). The movable armature 1514 can be pulled toward a respective tine or pushed away from a respective tine depending on the direction of the current through the coil 1508. Additionally, the amount of force applied to the movable armature 1514 can be controlled by controlling the amount of current applied to the coil 1508. Since force is approximately equal to the square of the magnetic field ($F \sim B^2$), the increase in the magnetic flux $\phi_{M2}$ by the coil magnetic flux $\phi_C$ increases the force. With the actuator 1500. $F \sim B^2$ can become $F=4B_mB_c$. Thus, the force is linear in applied current.

A polarized electromagnetic actuator can be thinner in height (z direction) than other electromagnetic actuators when the magnetic flux from a coil does not pass through a permanent magnet and the magnetic flux from the permanent magnet(s) does not travel through the coil. The material in which a coil surrounds can be thinned to account for the diameter of the coil. And in some embodiments, it is desirable to have the field going through the coil be as small as possible. So to avoid saturation, the actuator is designed so the magnetic flux from the permanent magnet does not pass through the coil since there may not be a sufficient amount of material in the coil to carry the magnetic flux from both the coil and the permanent magnet(s).

Figure 15:
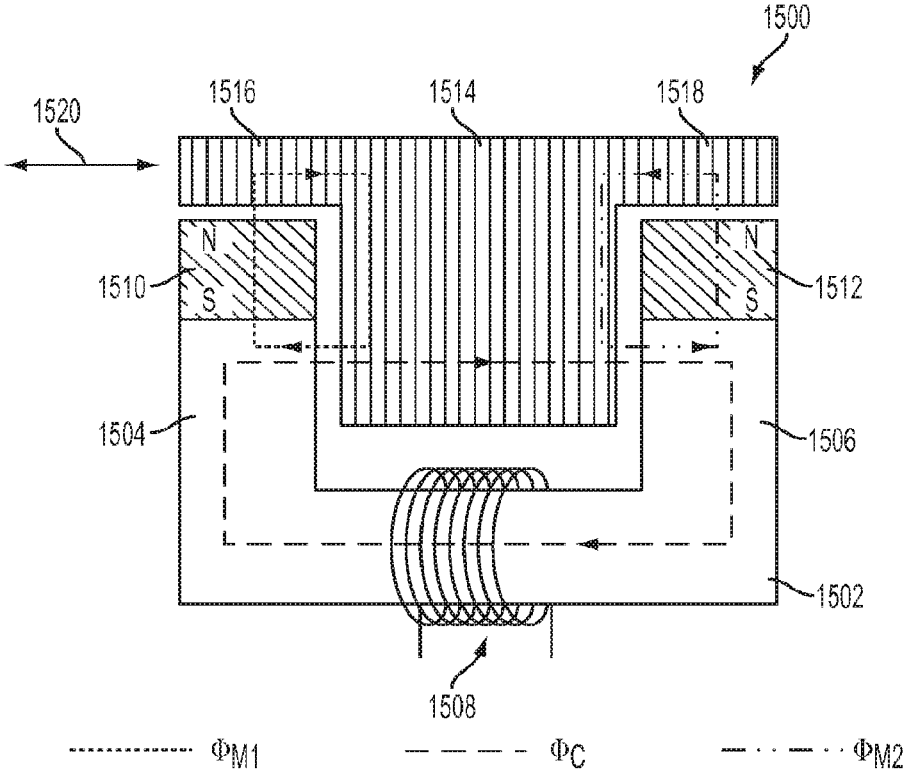
FIG. 15 is a simplified illustration of a fifth example of a polarized electromagnetic actuator.
Figure 16:
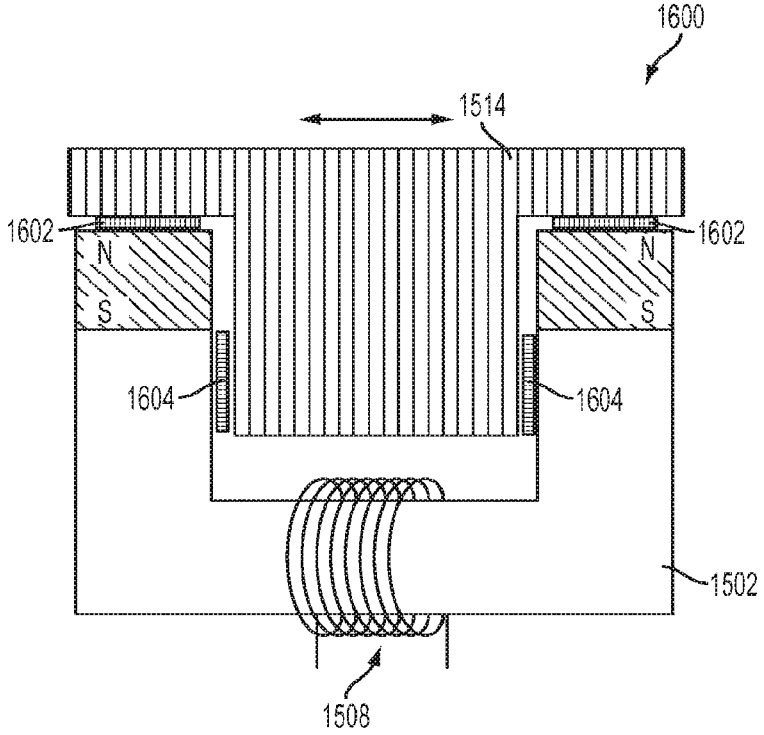
FIG. 16 depicts one method for providing a restoring force to the polarized electromagnetic actuator shown in FIG. 15.

FIG. 16 depicts one method for providing a restoring force to the polarized electromagnetic actuator shown in FIG. 15. The actuator 1600 can include stabilizing elements 1602, 1604, which can be implemented as gel disks or pads. The gel disks 1602 can be positioned between the arms of the T-shaped armature 1514 and the permanent magnets 1510, 1512. The gel disks 1604 can be located between the body of the T-shaped armature 1514 and the tines 1504, 1506. Alternatively or additionally, the gel disks 1604 can be positioned between the body of the T-shaped armature 1514 and the permanent magnets 1510, 1512, or between the body of the T-shaped armature 1514 and both the permanent magnets 1510, 1512 and the tines 1504, 1506. The gel disks or pads 1602, 1604 stabilize the armature 1514 in the spaces between the stator 1502 and the permanent magnets 1510, 1512 when a current is not applied to the coil 1508. Other embodiments can include a fewer or greater number of stabilizing elements.

Figure 17:
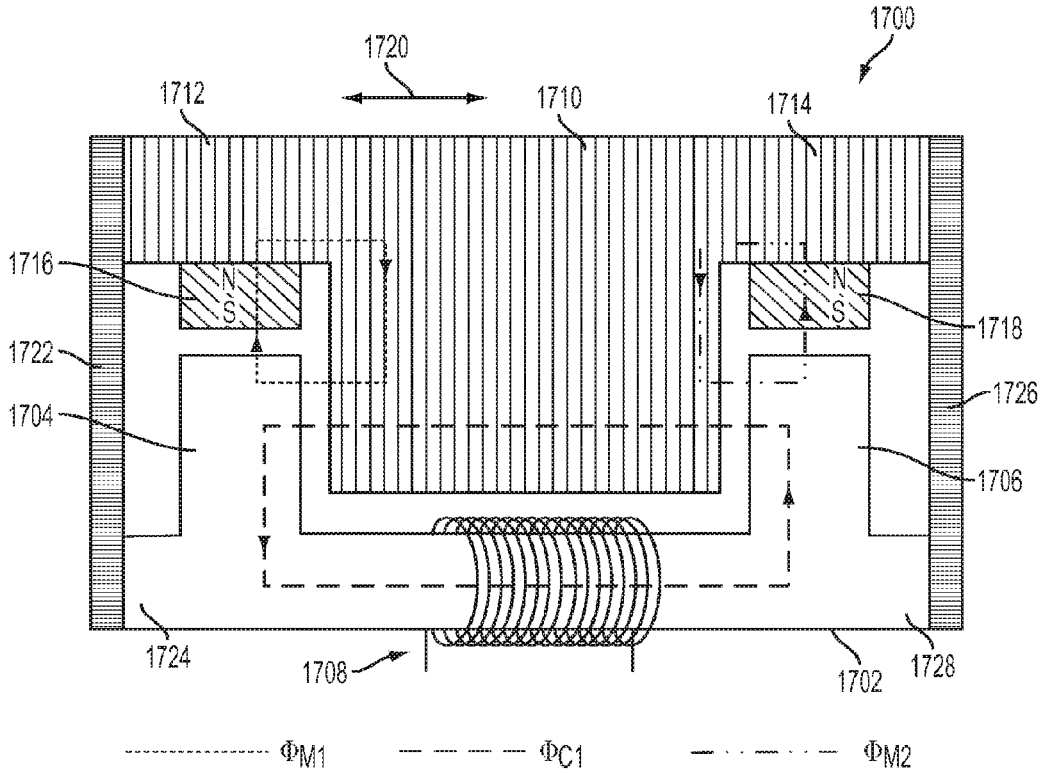
FIG. 17 is a simplified illustration of a sixth example of a polarized electromagnetic actuator.

Referring now to FIG. 17, there is shown a simplified illustration of a sixth example of a polarized electromagnetic actuator. Like the embodiment shown in FIG. 15, the coil magnetic flux does not pass through the permanent magnets and the magnetic fluxes of the permanent magnets does not travel through the coil.

The actuator 1700 includes a stator 1702 with two tines 1704, 1706 extending out from the stator 1702 to form a "U" shaped region of the stator 1702. A helical coil 1708 is wrapped around the stator 1702 between the two tines 1704, 1706. A movable armature 1710 can be formed in a "T" shape with the arms 1712, 1714 of the T-shaped armature 1710 disposed over the tines 1704, 1706, respectively. The body of the T-shaped armature 1710 is positioned over the coil 1708 within the "U" shaped region between the tines 1704, 1706. A first permanent magnet 1716 is attached to one arm 1714 and positioned over the tine 1704 and a second permanent magnet 1718 is attached to the other arm 1716 and disposed over the tine 1706. The movable armature 1710 and the permanent magnets 1716, 1718 are held in a spaced-apart relationship to the stator 1702.

The permanent magnet 1716 produces a magnetic flux $\phi_{M1}$ and the permanent magnet 1718 produces a magnetic flux $\phi_{M2}$. The magnetic fluxes $\phi_{M1}$, $\phi_{M2}$ provide a background magnetic flux around respective permanent magnets 1716, 1718, through the movable armature 1710, and through the tines 1704, 1706 (but not through the coil 1708). Additionally, a magnetic flux $\phi_C$ is produced when a current is applied to the coil 1708. The coil magnetic flux $\phi_C$ travels through the body of the T-shaped armature 1710 and around the stator 1702 and tines 1704, 1706, but not (or largely not) through the permanent magnets 1716, 1718. As with the other embodiments, the direction of travel of the coil magnetic flux $\phi_C$ depends on the direction of the current passing through the coil 1708.

The magnetic flux $\phi_C$ produced by the coil 1708 interacts with the magnetic flux $\phi_{M1}$, $\phi_{M2}$ of the permanent magnets 1716, 1718 to reduce or cancel one magnetic flux ($\phi_{M1}$ or $\phi_{M2}$) and increase the other magnetic flux. Motion is produced in the movable armature 1710 in the direction of the increased magnetic flux (motion represented by arrow 1720). The armature 1710 moves in a left direction or in a right direction based on the direction of the increased magnetic flux. For example, in the illustrated embodiment, the coil magnetic flux $\phi_C$ is traveling in a direction that opposes the direction of the magnetic flux $\phi_{M2}$, thereby reducing or canceling the magnetic flux $\phi_{M2}$. Concurrently, the coil magnetic flux $\phi_C$ is traveling in the same direction as the direction of the magnetic flux $\phi_{M1}$, thereby increasing the magnetic flux $\phi_{M1}$. The increase in the magnetic flux $\phi_{M1}$ by the magnetic flux $\phi_C$ increases the amount of force applied to the movable armature 1710.

As previously described, the armature 1710 moves left or right based on the force applied to the armature. The movable armature 1710 can be pulled toward a respective tine or pushed away from a respective tine depending on the direction of the current through the coil 1708. In the illustrated embodiment, a first bending flexure 1722 is attached to the outer ends of the arm 1712 and the protrusion 1724 of the stator 1702. A second bending flexure 1726 is attached to the outer ends of the arm 1714 and the protrusion 1728 of the stator 1702. The bending flexures 1722, 1726 can limit the movement of the armature 1710. The bending flexures 1722, 1726 can act as stabilizing elements by counteracting the attraction between the permanent magnets 1716, 1718 and the stator 1702. The spring constants of the bending flexures 1722, 1726 can stabilize the armature 1710 in the center of its travel. Other embodiments can include a fewer or greater number of stabilizing elements.

Figure 18:
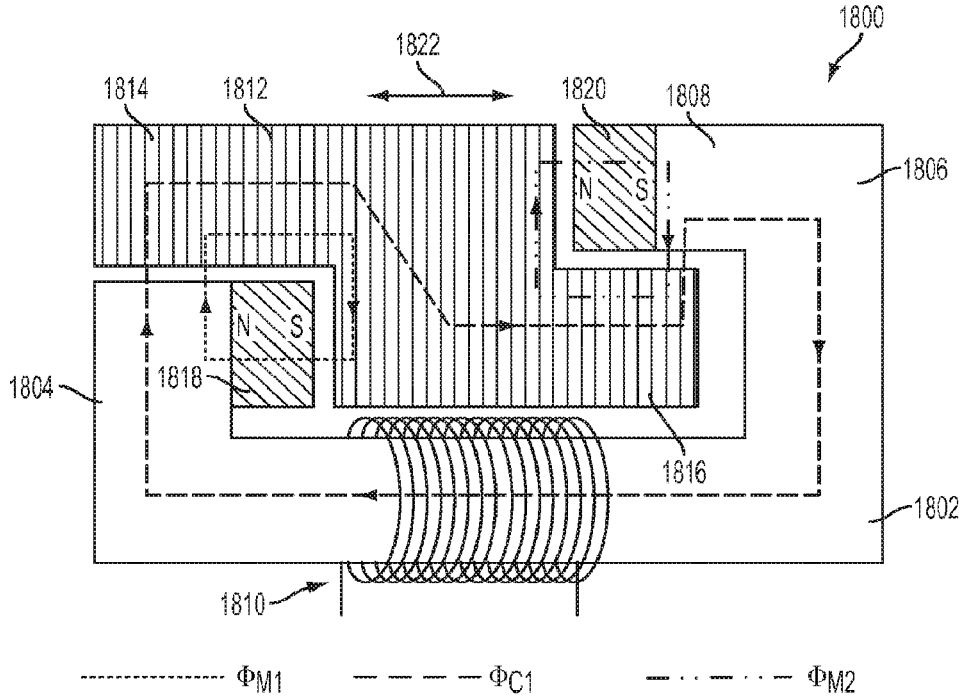
FIG. 18 is a simplified illustration of a seventh example of a polarized electromagnetic actuator.

FIG. 18 is a simplified illustration of a seventh example of a polarized electromagnetic actuator. The actuator 1800 includes a stator 1802 with two tines 1804, 1806 extending out from the stator 1802. The first tine 1804 can be perpendicular to the stator 1802 while the other tine 1806 can extend out from the stator and have an upside down reversed "L" shape. In other words, the tine 1806 can extend out from the stator 1802 and can include an overhang 1808 that extends out perpendicularly from the tine 1806 towards the tine 1804. A helical coil 1810 is wrapped around the stator 1802 between the two tines 1804, 1806.

A movable armature 1812 can include an arm 1814 that is positioned over the tine 1804 and another arm 1816 that is positioned under the overhang 1808 of the second tine 1806. The body of the armature 1812 is positioned over the coil 1810 between the tines 1804, 1806. A first permanent magnet 1818 is attached to the tine 1804 between the tine 1804 and armature 1812. A second permanent magnet 1820 is attached to the outer end of the overhang 1808 between the overhang 1808 and the armature 1812. The movable armature 1812 is held in a spaced-apart relationship to the stator 1802 and the permanent magnets 1818, 1820.

The permanent magnet 1818 produces a magnetic flux $\phi_{M1}$ and the permanent magnet 1820 produces a magnetic flux $\phi_{M2}$. The magnetic fluxes $\phi_{M1}$, $\phi_{M2}$ provide a background magnetic flux around respective permanent magnets 1818, 1820 through the movable armature 1812, through the tine 1804, and through the overhang 1808 (but not through the coil 1810). Additionally, a magnetic flux $\phi_C$ is produced when a current is applied to the coil 1810. The coil magnetic flux $\phi_C$ travels through the armature 1812 and around the stator 1802 and tines 1804, 1806, but not (or largely not) through the permanent magnets 1818, 1820. As with the other embodiments, the direction of travel of the coil magnetic flux $\phi_C$ depends on the direction of the current passing through the coil 1810.

The magnetic flux $\phi_C$ produced by the coil 1810 interacts with the magnetic flux $\phi_{M1}$, $\phi_{M2}$ of the permanent magnets 1818, 1820 to reduce or cancel one magnetic flux ($\phi_{M1}$ or $\phi_{M2}$) and increase the other magnetic flux. Motion is produced in the movable armature 1812 in the direction of the increased magnetic flux (motion represented by arrow 1822).

Figure 19:
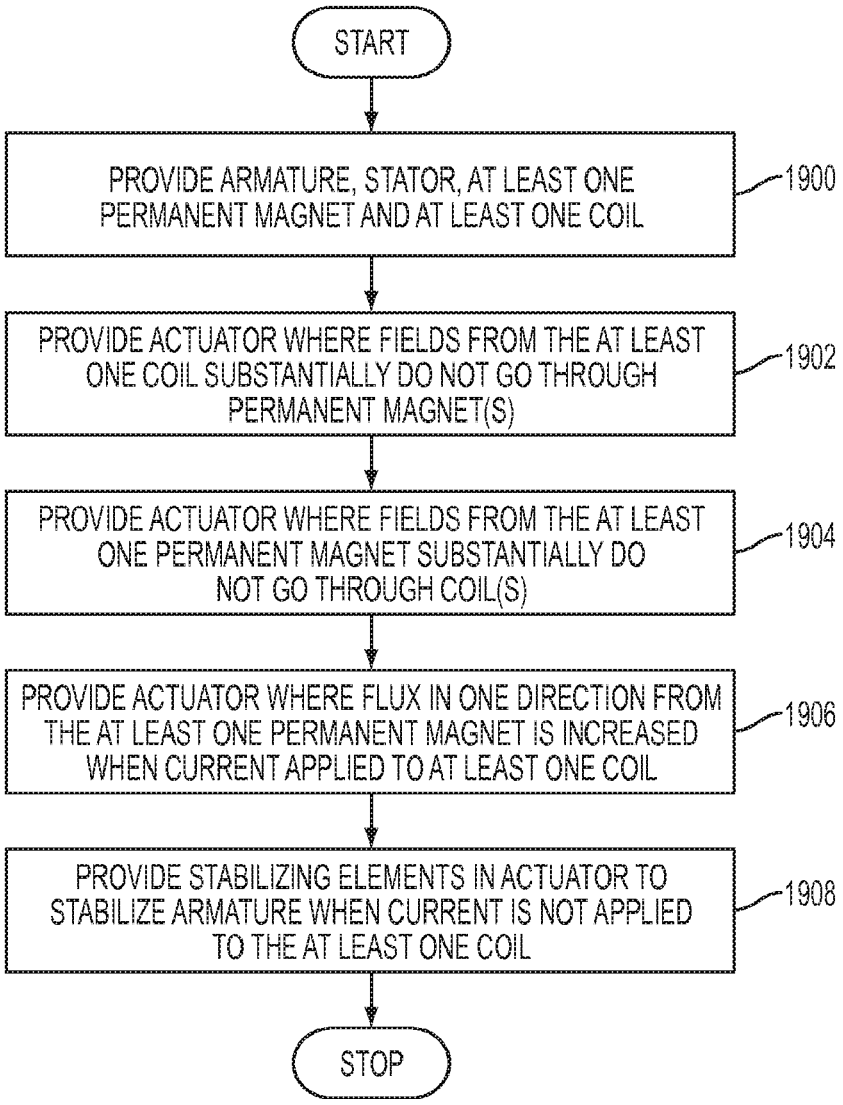
FIG. 19 is a flowchart of one example method of providing a polarized electromagnetic actuator.

FIG. 19 is a flowchart of one example method of providing a polarized electromagnetic actuator. Initially a movable armature, a stator, a coil, and a permanent magnet of the actuator are provided, as shown in block 1900. Although only one coil and only one permanent magnet are described, those skilled in the art will recognize that a polarized electromagnetic actuator can include one or more coils and/or one or more permanent magnets.

The movable armature and stator can have a desired shape and thickness based on the amount of force to be generated by the actuator. The movable armature, stator, coil, and permanent magnet of the actuator are then configured at block 1902 such that the field produced by the coil does not pass through the permanent magnet. The movable armature, stator, coil, and permanent magnet of the actuator can also be configured such that the field produced by the permanent magnet does not pass through the coil (block 1904). Block 1904 can be omitted in some embodiments.

The movable armature, stator, coil, and permanent magnet of the actuator are configured so that the magnetic flux of the coil $\phi_c$ increases the magnetic flux of the permanent magnet in one direction to produce motion in the direction of the increased magnetic flux (block 1906). Next, as shown in block 1908, one or more stabilizing elements are provided to stabilize the movable armature when a current is not applied to the coil.

Figure 20:
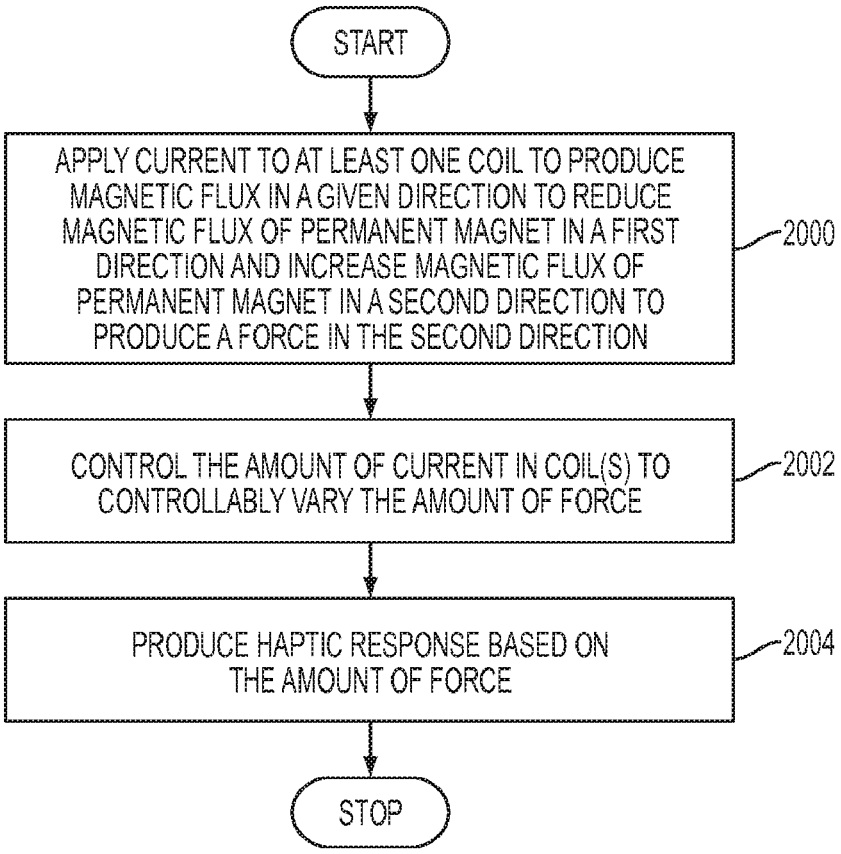
FIG. 20 is a flowchart of one example method of operating a polarized electromagnetic actuator.

Referring now to FIG. 20, there is shown a flowchart of one example method of operating a polarized electromagnetic actuator. Initially, at block 2000 a current is applied to each coil in the actuator. The current flows through each coil in a given direction to produce a magnetic flux in a first direction. The magnetic flux of the coil can increase a magnetic flux of at least one permanent magnet included in the actuator in the first direction to produce a force in the first direction. The force can produce motion in the at least the first direction.

The amount of current flowing through the coil can be controlled to controllably vary the amount of force applied to a movable armature and to produce motion in the direction of the increased magnetic flux associated with the at least one permanent magnet (block 2002). The amount of current passing through the coil can be increased or decreased depending on the desired amount of force and the desired direction of movement.

Next, as shown in block 2004, a haptic response can be produced based on the force produced by the polarized electromagnetic actuator. The haptic response can be in one direction and/or in multiple directions based on the direction of the current passing through each coil. Additionally or alternatively, the magnitude of the haptic response can be controlled based on the amount of current passing through each coil.

Other embodiments can perform the method shown in FIG. 20 differently. For example, in one embodiment, block 2002 can be omitted. In other embodiments, block 2004 can be performed before block 2002.

Embodiments of polarized electromagnetic actuators can be included in any type of device. For example, acoustical systems such as headphones and speakers, computing systems, haptic systems, and robotic devices can include one or more polarized electromagnetic actuators. Haptic systems can be included in computing devices, digital media players, input devices such as buttons, trackpads, and scroll wheels, smart telephones, and other portable user electronic devices to provide tactile feedback to a user. For example, the tactile feedback can take the form of an applied force, a vibration, or a motion. One or more polarized electromagnetic actuators can be included in a haptic system to enable the tactile feedback (e.g., motion) that is applied to the user.

Figure 21:
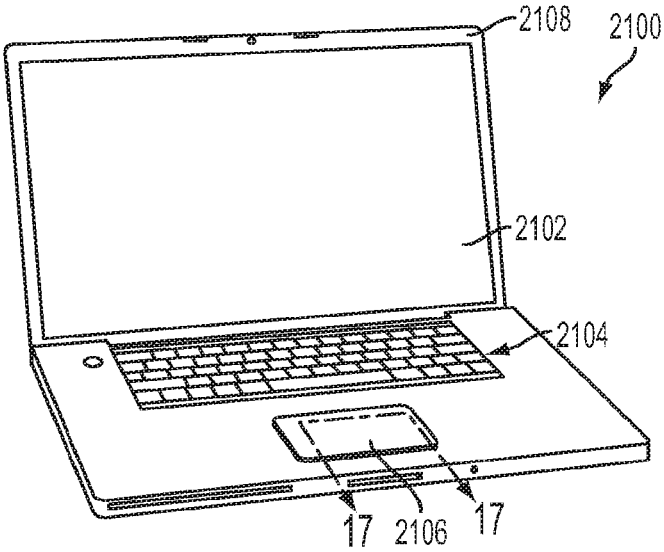
FIG. 21 is a front perspective view of an electronic device that can include one or more polarized electromagnetic actuators.

FIG. 21 is a front perspective view of an electronic device that can include one or more polarized electromagnetic actuators. The polarized electromagnetic actuators can be used, for example, to provide haptic feedback to a user. As shown in FIG. 21, the electronic device 2100 can be a laptop or netbook computer that includes a display 2102, a keyboard 2104, and a touch device 2106, shown in the illustrated embodiment as a trackpad. An enclosure 2108 can form an outer surface or partial outer surface and protective case for the internal components of the electronic device 2100, and may at least partially surround the display 2102, the keyboard 2104, and the trackpad 2106. The enclosure 2108 can be formed of one or more components operably connected together, such as a front piece and a back piece.

The display 2102 is configured to display a visual output for the electronic device 2100. The display 2102 can be implemented with any suitable display, including, but not limited to, a liquid crystal display (LCD), an organic light-emitting display (OLED), or organic electro-luminescence (OEL) display.

The keyboard 2104 includes multiple keys that can be used to enter data into an application or program, or to interact with one or more viewable objects on the display 2102. The keyboard 2104 can include alphanumeric or character keys, navigation keys, function keys, and command keys. For example, the keyboard can be configured as a QWERTY keyboard with additional keys such as a numerical keypad, function keys, directional arrow keys, and other command keys such as control, escape, insert, page up, page down, and delete.

The trackpad 2106 can be used to interact with one or more viewable objects on the display 2102. For example, the trackpad 2106 can be used to move a cursor or to select a file or program (represented by an icon) shown on the display. The trackpad 2106 can use any type of sensing technology to detect an object, such as a finger or a conductive stylus, near or on the surface of the trackpad 2106. For example, the trackpad 2106 can include a capacitive sensing system that detects touch through capacitive changes at capacitive sensors.

The trackpad 2106 can include one or more polarized electromagnetic actuators to provide haptic feedback to a user. For example, a cross-section view of the trackpad 2106 along line 17-17 can include the cross-section view of the polarized electromagnetic actuator shown in FIG. 17. The top surface of the trackpad 2106 can be the top surface of the movable armature 1710, and the actuator can be included under the top surface of the trackpad 2106. In other embodiments, one or more polarized electromagnetic actuators included in the trackpad 2106 can be implemented as one or more actuators shown in FIGS. 3, 7, 8, 11-16, and FIG. 18. The polarized electromagnetic actuators can be positioned in the same direction or in different directions. For example, one polarized electromagnetic actuator can provide motion along an x-axis while a second polarized electromagnetic actuator provides motion along a y-axis.

Additionally or alternatively, one or more keys in the keyboard 2104 can include a polarized electromagnetic actuator or actuators. The top surface of a key in the keyboard can be the top surface of the movable armature, and the actuator can be included under the top surface of the key.

Figure 22:
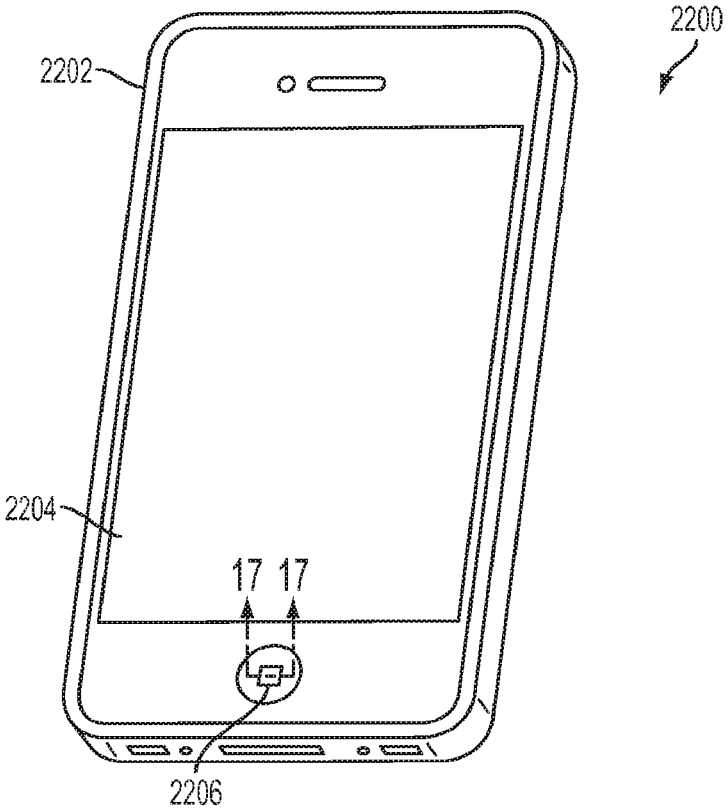
FIG. 22 is a front perspective view of another electronic device that can include one or more polarized electromagnetic actuators.

Referring now to FIG. 22, there is shown a front perspective view of another electronic device that can include one or more polarized electromagnetic actuators. In the illustrated embodiment, the electronic device 2200 is a smart telephone that includes an enclosure 2202 surrounding a display 2204 and one or more buttons 2206 or input devices. The enclosure 2202 can be similar to the enclosure described in conjunction with FIG. 21, but may vary in form factor and function.

The display 2204 can be implemented with any suitable display, including, but not limited to, a multi-touch touchscreen display that uses liquid crystal display (LCD) technology, organic light-emitting display (OLED) technology, or organic electro luminescence (OEL) technology. The multi-touch touchscreen display can include any suitable type of touch sensing technology, including, but not limited to, capacitive touch technology, ultrasound touch technology, and resistive touch technology.

The button 2206 can take the form of a home button, which may be a mechanical button, a soft button (e.g., a button that does not physically move but still accepts inputs), an icon or image on a display, and so on. Further, in some embodiments, the button 2206 can be integrated as part of a cover glass of the electronic device.

In some embodiments, the button 2206 can include one or more polarized electromagnetic actuators to provide haptic feedback to the user. A cross-section view of the button 2206 along line 17-17 can include the cross-section view of the polarized electromagnetic actuator shown in FIG. 17. The top surface of the button can be the top surface of the movable armature 1710, and the actuator can be included under the top surface of the button 2206. In other embodiments, one or more polarized electromagnetic actuators included in the button 2206 can be implemented as one or more actuators shown in FIGS. 3, 7, 8, 11-16, and FIG. 18. The polarized electromagnetic actuators can be positioned in the same direction or in different directions. For example, one polarized electromagnetic actuator can provide motion along an x-axis while a second polarized electromagnetic actuator provides motion along a y-axis.

Additionally or alternatively, a portion of the enclosure 2202 and/or the display 2204 can include one or more polarized electromagnetic actuators to provide haptic feedback to the user. The exterior surface of the enclosure and/or the display can be the top surface of the movable armature with the actuator included under the top surface of the enclosure and/or display. As with the button 2206, the polarized electromagnetic actuators can be positioned in the same direction or in different directions.

Various embodiments have been described in detail with particular reference to certain features thereof, but it will be understood that variations and modifications can be effected within the spirit and scope of the disclosure. And even though specific embodiments have been described herein, it should be noted that the application is not limited to these embodiments. In particular, any features described with respect to one embodiment may also be used in other embodiments, where compatible. Likewise, the features of the different embodiments may be exchanged, where compatible.

What is claimed is:

1. A polarized electromagnetic actuator, comprising:

a stator including two tines extending out from the stator;

a movable armature disposed over the two tines of the stator;

a first stabilizing element connecting the movable armature and the stator;

a second stabilizing element connecting the movable armature and the stator;

a first coil positioned around one tine;

a second coil positioned around the other tine;

a first permanent magnet disposed over the stator between the two tines, wherein a magnetic flux of the first and the second coils increases a magnetic flux of the first permanent magnet in one direction to produce motion in the movable armature; and a second permanent magnet disposed over the stator between the two tines;

wherein the first stabilizing element is disposed around a first end of the stator and a first end of the moveable armature; and the second stabilizing element is disposed around a second end of the stator and a second end of the moveable armature.

2. The polarized electromagnetic actuator as in claim 1, further comprising a pivot disposed between the permanent magnet and the movable armature.

3. The polarized electromagnetic actuator as in claim 1, further comprising a pivot disposed between the movable armature and the stator and between the first and second permanent magnets.

4. The polarized electromagnetic actuator of claim 1, wherein the first and second stabilizing elements cause the polarized electromagnetic actuator to be stable at zero displacement of the armature.

5. A polarized electromagnetic actuator, comprising:

a stator including two tines extending out from the stator;

a movable armature positioned between the two tines of the stator;

a first coil positioned around one tine;

a second coil positioned around the other tine; and a permanent magnet disposed under the movable armature and over the stator between the two tines, wherein a magnetic flux of the first and second coils increases a magnetic flux of the permanent magnet in one direction to produce motion in the movable armature.

6. The polarizing electromagnetic actuator as in claim 5, further comprising one or more stabilizing elements disposed between the permanent magnet and the movable armature.

7. The polarizing electromagnetic actuator as in claim 5, further comprising one or more stabilizing elements disposed between the movable armature and at least one tine of the stator.

8. The polarizing electromagnetic actuator as in claim 5, further comprising one or more bending flexures disposed between the stator and the movable armature.

9. A polarized electromagnetic actuator, comprising:

a movable armature including two tines extending out from the armature;

a stator disposed over the two tines of the movable armature;

a permanent magnet disposed under the stator and over the movable armature between the two tines;

a first coil positioned around the stator between one tine of the armature and the permanent magnet; and a second coil positioned around the stator between the other tine and the permanent magnet.

10. A polarized electromagnetic actuator, comprising:

a stator including two tines extending out from the stator;

a coil positioned around the stator between the two tines;

a first permanent magnet disposed over one tine of the stator;

a second permanent magnet disposed over the other tine of the stator; and a movable armature including a first arm disposed over the first permanent magnet and a second arm disposed over the second permanent magnet and a body disposed between the two tines, wherein a magnetic flux of the coil increases a magnetic flux of one permanent magnet to produce motion in the movable armature in a direction of the increased magnetic flux.

11. The polarized electromagnetic actuator as in claim 10, further comprising at least one stabilizing element disposed between the body of the movable armature and at least one tine of the stator.

12. The polarized electromagnetic actuator as in claim 10, further comprising at least one stabilizing element disposed between at least one permanent magnet and a respective arm of the movable armature.

13. A polarized electromagnetic actuator, comprising:

a stator including two tines extending out from the stator;

a coil positioned around the stator between the two tines;

a movable armature including:

a first arm disposed over one tine of the stator;

a second arm disposed over the other tine of the stator; and a body disposed between the two tines;

a first permanent magnet attached to the first arm of the movable armature and disposed over one tine of the stator; and a second permanent magnet attached to the second arm of the movable armature and disposed over the other tine of the stator, wherein a magnetic flux of the coil increases a magnetic flux of one permanent magnet to produce motion in the movable armature in a direction of the increased magnetic flux.

14. The polarized electromagnetic actuator as in claim 13, further comprising at least one stabilizing element attached to an outer end of a respective arm of the armature and the stator.

15. A method for providing a polarized electromagnetic actuator comprising:

providing a stator that includes two tines extending out from the stator;

providing a movable armature between the two tines of the stator;

providing a first coil positioned around a first tine of the stator and a second coil positioned around a second tine of the stator;

providing at least one permanent magnet under the movable armature and over the stator between the two tines; and configuring the at least one coil to increase a magnetic flux of the at least one permanent magnet in one direction when a current is applied to the at least one coil, wherein the movable armature moves in the direction of the increased magnetic flux.

16. The method as in claim 15, further comprising providing one or more stabilizing elements to ends of the movable armature to stabilize the movable armature when a current is not applied to the at least one coil.

17. A polarized electromagnetic actuator, comprising:

a stator including two tines extending out from the stator; a coil positioned around the stator between the two tines;

a movable armature including a first arm disposed over one tine of the stator, a second arm disposed under the other tine of the stator, and a body disposed between the two tines;

a first permanent magnet attached to one tine of the stator; and a second permanent magnet attached to the other tine of the stator, wherein the coil produces a first magnetic flux when a current is applied to the coil and the magnetic flux of the coil increases a magnetic flux of one permanent magnet to produce motion in the movable armature in a direction of the increased magnetic flux.

18. The method as in claim 15, further comprising providing one or more stabilizing elements to the permanent magnet to stabilize the movable armature when a current is not applied to the at least one coil.

19. The method as in claim 15, further comprising providing one or more stabilizing elements connecting the stator to the movable armature to stabilize the movable armature when a current is not applied to the at least one coil.

20. The method as in claim 15, wherein the one or more stabilizing elements provided to ends of the movable armature are connected to the stator.

21. A method for providing a polarized electromagnetic actuator comprising:

providing a stator that includes two tines extending out from the stator;

providing a movable armature spaced having an arm disposed over each tine of the stator and body disposed between the two tines of the stator;

providing at least one coil positioned around the stator between the two tines;

providing a first permanent magnet between a first arm of the movable armature and a first tine of the stator that the arm is disposed over;

providing a second permanent magnet between a second arm of the movable armature and a second tine of the stator that the arm is disposed over; and configuring the at least one coil to increase a magnetic flux of at least one permanent magnet in one direction when a current is applied to the at least one coil, wherein the movable armature moves in the direction of the increased magnetic flux.

22. The method of claim 21, wherein the first permanent magnetic is attached to the first arm of the movable armature and the second permanent magnet is attached to the second arm of the movable armature.

23. The method of claim 21, wherein the first permanent magnetic is attached to the first tine of the stator and the second permanent magnet is attached to the second tine of the stator.

24. The method of claim 21, further comprising providing one or more stabilizing elements to the body of the movable armature to stabilize the movable armature when a current is not applied to the at least one coil.

* * * * *